US008752824B2

(12) United States Patent
Fujiwara et al.

(10) Patent No.: US 8,752,824 B2
(45) Date of Patent: Jun. 17, 2014

(54) SHEET INVERTING DEVICE AND IMAGE FORMING APPARATUS INCORPORATING SAME

(75) Inventors: Hiroshi Fujiwara, Osaka (JP); Tomoyoshi Yamazaki, Tokyo (JP); Haruyuki Honda, Osaka (JP); Toshikane Nishii, Osaka (JP); Mizuna Tanaka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 253 days.

(21) Appl. No.: 13/067,221

(22) Filed: May 18, 2011

(65) Prior Publication Data

US 2011/0285076 A1 Nov. 24, 2011

(30) Foreign Application Priority Data

May 20, 2010 (JP) ..... 2010-116515
Feb. 28, 2011 (JP) ..... 2011-043058

(51) Int. Cl.
*B65H 29/00* (2006.01)

(52) U.S. Cl.
USPC ..... 271/186; 271/225; 271/301

(58) Field of Classification Search
USPC ..... 271/186, 225, 301
See application file for complete search history.

(56) References Cited

U.S. PATENT DOCUMENTS

| | | | | |
|---|---|---|---|---|
| 2004/0155955 | A1* | 8/2004 | Hamano et al. | 347/249 |
| 2008/0106028 | A1* | 5/2008 | Meadows et al. | 271/117 |
| 2008/0251991 | A1* | 10/2008 | Doyo | 271/109 |
| 2010/0247193 | A1 | 9/2010 | Suzuki | |

FOREIGN PATENT DOCUMENTS

| | | | |
|---|---|---|---|
| JP | 2657835 | | 5/1990 |
| JP | 11092041 | A | 4/1999 |
| JP | 2000-313568 | | 11/2000 |
| JP | 3780193 | | 4/2003 |
| JP | 2004-085632 | | 3/2004 |
| JP | 2006064727 | A | 3/2006 |
| JP | 2008096798 | A | 4/2008 |
| JP | 2008-150206 | | 7/2008 |
| JP | 4139790 | | 8/2008 |
| JP | 2009-190886 | | 8/2009 |

OTHER PUBLICATIONS

Translation of JP,2008-096798,A.*
Abstract of JP 02117569 published May 2, 1990.
Abstract of JP 2003104613 published Apr. 9, 2003.
Office Action for corresponding Chinese patent application No. 201110127003.8 dated Aug. 28, 2013.

* cited by examiner

*Primary Examiner* — Michael McCullough
*Assistant Examiner* — Howard Sanders
(74) *Attorney, Agent, or Firm* — Harness, Dickey & Pierce, P.L.C.

(57) ABSTRACT

A sheet inverting device includes a loop pathway including an entrance slot to which a recording medium is conveyed and an exit slot from which the recording medium is conveyed, the loop pathway forming a loop shape to convey the recording medium therethrough in a forward direction defined by a sheet conveyance direction in which the recording medium is conveyed from the entrance slot travels, and a redirectable sheet conveyance member to convey the recording medium traveling through the loop pathway in the forward direction and a reverse direction that is the reverse of the forward direction. The exit slot is configured to convey the recording medium that is conveyed by the redirectable sheet conveyance member in the reverse direction outside the sheet inverting device therethrough.

19 Claims, 11 Drawing Sheets

$\theta a > \theta b,\ \theta a > \theta c$

SHEET INVERTING DEVICE AND IMAGE FORMING APPARATUS INCORPORATING SAME

CROSS-REFERENCE TO RELATED APPLICATIONS

The present invention claims priority pursuant to 35 U.S.C. §119 from Japanese Patent Application No. 2010-116515, filed on May 20, 2010 in the Japan Patent Office, and Japanese Patent Application No. 2011-043058, filed on Feb. 28, 2011 in the Japan Patent Office, which are hereby incorporated by reference herein in their entirety.

BACKGROUND OF THE INVENTION

1. Field of the Invention

Embodiments of the present invention relate to a sheet inverting device and an image forming apparatus incorporating the sheet inverting device, more particularly to a sheet inverting device that reverses or turns over sheet-like recording media to expose a front side and then an opposite side for image formation, and an image forming apparatus, such as a copier, printer, facsimile machine, plotter, inkjet printer, and a multifunctional machine including at least two of functions of the copier, printer, facsimile machine, plotter, and inkjet printer, which incorporates the sheet inverting device.

2. Description of the Related Art

A wide variety of image forming apparatuses incorporating an automatic duplex printing function that forms and prints images on front and opposite sides of a sheet also include a sheet inverting device that can switch the sheet back to turn over the front side and the opposite side of the sheet.

It is generally known that sheet inverting devices expose the leading edge of a sheet having a first image formed on a front side thereof to the outside to reverse the sheet for printing either a second image on an opposite side thereof, switch back the sheet with a pair of sheet discharging rollers that can rotate in forward and reverse directions to convey the sheet in a reversing pathway (or a duplex side feed pathway) for turning over the first side having the printed first image thereon, print the second image on the second side thereof in an image forming unit where the first image has been printed on the first side of the sheet, and discharge the sheet with the pair of sheet discharging rollers to a sheet discharging tray.

It is also known that sheet inverting devices convey a sheet into a sheet reversing pathway and then reverse a direction of rotation of a pair of sheet reversing rollers to convey the sheet from the sheet reversing pathway to another pathway for turning over the sheet.

For the purpose of forming the reversing pathway of a duplex conveyance unit that can process a long-length sheet without increasing a width or a height of the image forming apparatus, Japanese Patent Application Publication No. JP-11-092041-A discloses an image forming apparatus that includes a sheet refeed pathway and a sheet reversing pathway. The sheet refeed pathway extends vertically to convey the sheet with an image on the first side thereof in a duplex conveyance unit toward a refeed sheet entrance to an image forming unit. The sheet reversing pathway extends parallel to the sheet refeed pathway. The sheet refeed pathway and the sheet reversing pathway merge in a vicinity of the refeed sheet entrance.

By contrast, Japan Patent No. 3620993 is known to have a method for reversing a sheet without providing the sheet reversing pathway. The sheet is then exposed to the outside from the sheet discharging exit and then taken into the device again so as to turn the sheet over.

Further, for encouraging improvement of productivity of digital image forming apparatuses performing duplex printing of multiple sheets of paper, it is known to employ an interleaving method as a duplex printing method as disclosed in Japanese Patent No. JP 3780193, for example. In the interleaving method, after a front side of a first sheet is printed, the first sheet is inverted and conveyed to the image forming section again so as to print an image on an opposite side thereof. The interleaving method uses this period of time, that is, performs printing of a front side of a second sheet, in the period in which both faces of the first sheet are printed.

SUMMARY OF THE INVENTION

The present invention describes a sheet inverting device. In one example, a novel sheet inverting device includes a loop pathway including an entrance slot to which a recording medium is conveyed and an exit slot from which the recording medium is conveyed, the loop pathway forming a loop shape to convey the recording medium therethrough in a forward direction defined by a sheet conveyance direction in which the recording medium is conveyed from the entrance slot travels, and a redirectable sheet conveyance member to convey the recording medium traveling through the loop pathway in the forward direction and a reverse direction that is the reverse of the forward direction. The exit slot conveys the recording medium that is conveyed by the redirectable sheet conveyance member in the reverse direction outside the sheet inverting device therethrough.

The above-described sheet inverting device may further include an export pathway to convey the recording medium to be ejected through the exit slot. The loop pathway may further include a first pathway extending from the entrance slot to the exit slot to convey the recording medium therethrough in the forward direction, a second pathway extending from the exit slot to the entrance slot to convey the recording medium therethrough in the forward direction, and a first angle formed between the second pathway and the export pathway is greater than a second angle formed between the first pathway and the export pathway in the vicinity of the exit slot.

The first pathway and the second pathway may extend substantially vertically.

The above-described sheet inverting device may further include a sheet conveying member provided in the second pathway to convey the recording medium to the exit slot. The sheet conveying member may convey the recording medium in forward and reverse directions.

The above-described sheet inverting device may further include a switching member to guide the recording medium conveyed in the first pathway and then redirected in the reverse direction by the redirectable sheet conveyance member to the second pathway.

The above-described sheet inverting device may further include a reentry pathway to re-convey the recording medium traveling in the reverse direction therein, the reentry pathway having one end at which the exit slot is formed, a junction at which the second end of the first pathway is connected to the first end of the second pathway, a first guide member located at the junction, having a first conveyance guide surface that defines the second pathway and a first inverting guide surface that defines the first pathway, a second guide member located at the junction, having a second inverting guide surface disposed facing the first inverting guide surface that defines the first pathway, a first reentry guide surface that defines the reentry pathway, and a peak point at which the first inverting guide surface and the first reentry guide surface meet, and a third guide member having a second conveyance surface disposed facing the first conveyance guide surface that defines the second pathway. The peak point may be located at a position retreated from an extended plane of the first conveyance guide surface and an extended plane of the first reentry guide surface, toward the second pathway and the reentry pathway. The second conveyance guide surface and an extended line of the second reverse guide surface may intersect the peak form an acute angle. The first conveyance guide surface and an extended line of the first reentry guide surface may intersect the peak form an acute angle.

The above-described sheet inverting device may further include an export pathway to convey the recording medium to be ejected through the exit slot. The loop pathway may further include a first pathway extending from the entrance slot to the exit slot to convey the recording medium therethrough in the forward direction, a second pathway extending from the exit slot to the entrance slot to convey the recording medium therethrough in the forward direction, and a first angle formed between the second pathway and the export pathway is greater than a third angle formed between the first pathway and the second pathway in the vicinity of the exit slot.

The loop pathway may include a first pathway extending from the entrance slot to the exit slot to convey the recording medium therethrough in the forward direction, a second pathway substantially extending from the exit slot to the entrance slot to convey the recording medium therethrough in the forward direction, and a guide member to guide the recording medium to be conveyed through the second pathway in the reverse direction to eject the recording medium from the exit slot without conveying the recording medium back to the first pathway.

The loop pathway may include a first pathway having a first end connected to the entrance slot, and a second pathway having a first end connected to the exit slot and positioned parallel to the first pathway. The first end of the first pathway may be connected to a second end of the second pathway and the first end of the second pathway may be connected to a second end of the first pathway.

The second end of the first pathway may be curved and connected to the first end of the second pathway.

The second end of the first pathway may be connected to a first end of the second pathway to cause the recording medium conveyed in the forward direction by a forward rotation of the redirectable sheet conveyance member to enter the second pathway in which the recording medium travels in the reverse direction from downstream to upstream.

The redirectable sheet conveyance member may be disposed at the first pathway. The second end of the second pathway may be connected to the first pathway at a downstream area in the vicinity of the first end of the first pathway. The second end of the first pathway may be curved and connected to the first end of the second pathway.

The above-described sheet inverting device may further include a simultaneous sheet conveying member to simultaneously convey a first recording medium sheet conveyed to enter the first pathway via the entrance slot and a second recording medium sheet conveyed to enter the second end of the second pathway in the reverse direction from the first pathway in opposite directions.

The redirectable sheet conveyance member may be disposed at the first pathway. The second end of the second pathway may be connected to the first pathway at a downstream area in the vicinity of the first end of the first pathway. The second end of the first pathway may be connected to the one end of the second pathway to cause the recording medium conveyed in the forward direction according to a forward rotation of the redirectable sheet conveyance member to enter the second pathway in which the recording medium travels in the reverse direction from downstream to upstream.

A length of the first pathway may be shorter than a maximum length of the recording medium to be reversed.

The above-described sheet inverting device may further include a sheet detector disposed in the vicinity of a junction of the second end of the second pathway and the first end of the first pathway to detect the recording medium as the recording medium passes thereby.

The recording medium is conveyed through the second end of the first pathway in a sheet conveyance direction from downward from upward in the second pathway. The above-described sheet inverting device may further include an elastic guide member to guide the recording medium conveyed in the reverse direction from upstream to downstream in the sheet conveyance direction through the second pathway to the exit slot disposed at a junction of the second end of the first pathway and the first end of the second pathway.

The recording medium with a first image on one side thereof may enter the entrance slot, and the exit slot serves as a reentry slot to which the recording medium having the image on the first side is conveyed again in the reverse direction.

Further, in one example, a novel image forming apparatus forms images on both sides of a sheet. The image forming apparatus includes the above-described sheet inverting device.

The image forming apparatus may further include a sheet container to contain multiple recording media sheets therein, an image forming unit disposed above the sheet container to form images on the recording medium conveyed from the sheet container, and a space provided above the image forming unit to which the recording media are discharged after image formation. The first pathway and the second pathway of the sheet inverting device extend substantially vertically.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
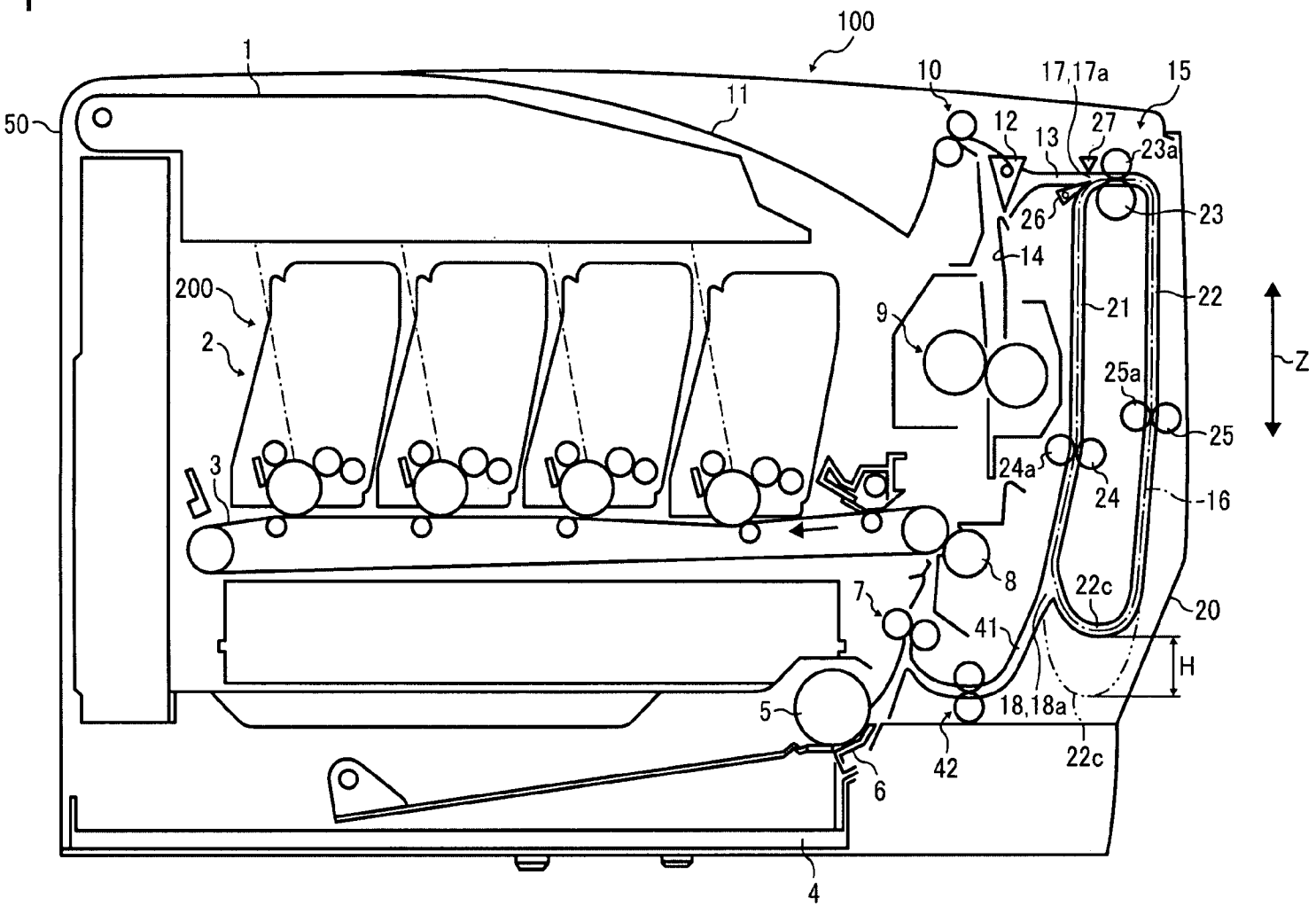
FIG. 1 is a schematic configuration of a printer serving as an image forming apparatus according to Embodiment 1 of the present invention, the printer including a duplex sheet inverting device.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Embodiment 1

Referring to FIGS. 1 through 6, descriptions are given of units, components, and operations of a sheet inverting device and a full-color compact printer 100 according to Embodiment 1 of the present invention. The full-color compact printer 100 serves as an image forming apparatus and hereinafter referred to as a printer 100 for simplicity.

FIG. 1 illustrates a schematic configuration of the printer 100. As illustrated in FIG. 1, the printer 100 includes a sheet feeding tray 4 and an image forming mechanism 200 in a main body 50 thereof.

The sheet feeding tray 4 serves as a sheet container to contain multiple sheets therein. The image forming mechanism 200 is disposed above the sheet feeding tray 4 and includes multiple image forming units 2. Each of the image forming units 2 forms an image to be printed on a sheet fed from the sheet feeding tray 4. The printer 100 employs a vertical sheet conveyance method to discharge a sheet to a portion disposed above the sheet after an image is formed on a sheet by the image forming mechanism 200. In FIG. 1, reference symbol "Z" indicates a vertical direction that corresponds to an upward and downward direction or a substantially vertical direction in the printer 100, as illustrated in FIG. 1.

Types of sheets that can be used in the printer 100 include a paper, a recording medium, a sheet-like resin film on which an image can be formed.

Further, the printer 100 includes a cover slope 20 that is disposed on the right side of a duplex sheet inverting device 15 and is openably closable with respect to the main body 50. The duplex sheet inverting device 15 serves as a sheet inverting device, details of which will be described below.

The image forming mechanism 200 of the printer 100 illustrated in FIG. 1 includes four image forming units 2 for forming four different single toner images (i.e., a black (BK) toner image, a yellow (Y) toner image, a magenta (M) toner image, and a cyan (C) toner image) and an intermediate transfer belt 3, to configure a full-color electrophotographic image forming system of an intermediate transfer type.

Each image forming unit 2 includes a drum-shaped photoconductor that serves as an image carrier, image forming components, such as a charging unit, a development unit, and a cleaning unit disposed around the photoconductor, and an optical writing device 1 from which a laser light beam (exposure) is emitted according to image data to the photoconductor.

The sheet feeding tray 4 is disposed below the image forming mechanism 200, which is a lowest part of the main body 50 of the printer 100. The sheet feeding tray 4 includes a sheet feed roller 5 and a sheet separation unit 6. The sheet feed roller 5 serves as a sheet feeding unit to feed sheets accommodated in the sheet feeding tray 4, one by one from the sheet feeding tray 4. The sheet separation unit 6 includes a sheet-like pad member having high friction with respect to sheets, employing a sheet separation unit of a so-called friction pad method.

The printer 100 according to Embodiment 1 is a compact printer. The sheet feeding tray 4 of the printer 100 accommodates sheets from A6 size to A4 size or Letter size in a regularly unit, and from A6 size to Legal size to the maximum with a tray extension unit attached thereto. The sheets are stored in a manner that a shorter side of the sheet is fed first as the leading edge thereof.

The sheet fed from the sheet feeding tray 4 is guided upward along a sheet pathway that extends in the vertical direction Z. Then, in synchronization with the movement of an intermediate transfer belt 3 at a pair of registration rollers 7, the sheet is conveyed to a nip formed between the intermediate transfer belt 3 and a secondary transfer roller 8. The intermediate transfer belt 3 and the secondary transfer roller 8 form an image transfer portion.

After the image formed on the intermediate transfer belt 3 is transferred onto one surface of the sheet at the image transfer portion, a fixing unit 9 fixes the image to a front side of the sheet. Then, the sheet is conveyed to a pair of sheet discharging rollers 10 to be discharged to a sheet discharging tray 11 that is disposed above the image forming mechanism 200.

By employing the vertical sheet conveyance method by which the sheet is fed from the sheet feeding tray 4 disposed at the lower portion of the printer 100 in the vertical direction Z toward the sheet discharging tray 11, the length of the sheet pathway can be reduced, thereby enabling a reduction in sheet conveyance time from a start of sheet conveyance to a completion of sheet discharge:

Next, a description is given of a configuration of the duplex sheet inverting device 15. The duplex sheet inverting device 15 serves as a sheet inverting device to invert or turn the sheet over to exchange one side thereof for the other and convey the sheet to the image transfer portion for forming an image on the other side (an opposite side) of the sheet after an image has been formed on the one side (a front side) thereof.

In the middle of a one-side printed sheet pathway 14 that serves as a sheet pathway from the fixing unit 9 to the pair of sheet discharging rollers 10, a first direction switching claw 12 is disposed between a pathway to the pair of sheet discharging rollers 10 and a pathway 13 to communicate with and connect to the duplex sheet inverting device 15. The first direction switching claw 12 serves as a first sheet redirecting member to change a direction of conveyance of a sheet or a sheet conveyance direction.

When a solenoid that serves as a drive unit starts driving, the first direction switching claw 12 rotates about a shaft of the solenoid. When the solenoid stops driving, an extension spring that serves as a biasing member maintains the first direction switching claw 12 at a position (an initial position, for example) as illustrated in FIG. 1. Various direction switching claws, which will be described later, are also rotated by respective solenoids in a known configuration same as the first direction switching claw 12.

The first direction switching claw 12 as illustrated in FIG. 1 is located at a position to convey a one-side printed sheet in a one-side printing mode or a two-side printed sheet in a duplex printing mode to a pathway on the side of the pair having sheet discharging rollers 10.

The duplex sheet inverting device 15 includes a reversing pathway 22 and a duplex sheet pathway 21.

The reversing pathway 22 serves as a first pathway to reverse a direction of conveyance of a sheet. One end of the reversing pathway 22 is connected to an entrance slot 17 of the pathway 13 to which a sheet of paper printed on one side (hereinafter, also referred to as a "one-side printed sheet") is conveyed.

The duplex sheet pathway 21 serves as a second pathway and is arranged parallel to the reversing pathway 22. One end of the duplex sheet pathway 21 is connected to a reentry slot 18 of a sheet reentry pathway 41 that serves as a reentry pathway and an export pathway, so that the switched-back sheet can be conveyed again to the inside of the main body 50 via the sheet reentry pathway 41.

Here, the reentry slot 18 functions as an exit slot according to the present invention so as to convey the sheet to the outside of the duplex sheet inverting device 15. The sheet reentry pathway 41 functions as a pathway that allows the sheet conveyed from the reentry slot 18 as an exit slot to pass therethrough.

The pathway 13 extends in a substantially horizontal direction from a connecting portion (hereinafter, also referred to as a "junction") where the pathway 13 meets with the one-side printed sheet pathway 14 to convey the one-side printed sheet to the duplex sheet inverting device 15. The entrance slot 17 of the pathway 13 is connected to the one end of the reversing pathway 22.

The pathways such as the pathway 13, the duplex sheet pathway 21, the reversing pathway 22, the sheet reentry pathway 41, and other pathways described later in the embodiments are defined by sheet conveyance guide members and/or other members unless otherwise specified.

The reversing pathway 22 and the duplex sheet pathway 21 extend substantially vertically or in the vertical direction Z as illustrated in FIG. 1. The reversing pathway 22 has a length that is shorter than the maximum length of a sheet to be reversed.

The one end of the reversing pathway 22 and the other end of the duplex sheet pathway 21 are connected at a connecting point or junction 17*a* that is located at an upper portion in FIG. 1. A first reversing roller 23 is disposed facing a driven roller 23*a* at the junction 17*a*, and one end of the pathway 13 having the entrance slot 17 is merged at the connecting point 17*a*.

The other end of the reversing pathway 22 that is located at the lower portion thereof is curved in the vertical direction Z, forming a convex shape toward an outside of the reversing pathway 22, and is connected to the one end of the duplex sheet pathway 21 in Embodiment 1. By so doing, a long and narrow loop pathway 16, which is illustrated with a dashed-dotted line in FIG. 1, is formed in the vertical direction Z in the reversing pathway 22 and the duplex sheet pathway 21.

In other words, the loop pathway 16 includes the entrance slot 17 into which the sheet moves, and the reentry slot 18 serving as an exit slot from which the sheet goes out. The loop pathway 16 is shaped to send the sheet in a loop manner in the direction of conveyance of the sheet entered from the entrance slot 17 as a forward direction (a clockwise direction in FIG. 1). By defining the direction of conveyance of the sheet to be entered from the entrance slot 17 as the forward direction, the loop pathway 16 can be defined as a pathway that includes the reversing pathway 22 serving as the first pathway that runs or extends from the entrance slot 17 to the reentry slot 18 to convey the sheet therethrough in the forward direction and the duplex sheet pathway 21 serving as the second pathway that runs or extends from the reentry slot 18 to the entrance slot 17 to convey the sheet therethrough in the forward direction.

As illustrated in FIG. 1, reference numeral "22*c*" represents a curved portion that is formed at a lower end of the reversing pathway 22, and reference numeral "18*a*" represents a connecting portion or a junction at which the other end of the reversing pathway 22, the one end of the duplex sheet pathway 21, and the one end of the sheet reentry pathway 41 including the reentry slot 18 meet. The curved portion 22*c* of the reversing pathway 21 can be extended downwardly, as illustrated with a broken line in FIG. 1, within a space H or a range that does not extend the maximum length of the sheet used for reversing the leading and trailing edge orientation of the sheet.

A switchback operation such as the reverse of the leading and trailing edge orientation of the one-side printed sheet and a sheet inverting operation can be performed in the loop pathway 16.

The duplex sheet pathway 21 includes a duplex sheet conveying roller 24, a driven roller 24*a*, and the reversing pathway 22 includes a second reversing roller 25 and a driven roller 25*a*. The driven roller 24*a* is disposed facing the duplex sheet conveying roller 24 to rotate with the duplex sheet conveying roller 24 at a given position of the duplex pathway 21. The driven roller 25*a* is disposed facing the second reversing roller 25 to rotate with the second reversing roller 25 at a given position of the reversing pathway 22.

The first reversing roller 23 and the second reversing roller 25 serve as redirectable sheet conveyance members to convey the sheet traveling through the loop pathway 16 in forward and reverse directions. The duplex sheet conveying roller 24 serves as a sheet conveying member provided in the duplex sheet pathway 21 to convey the sheet in forward and reverse directions.

A second direction switching claw 26 that serves as a second sheet redirecting member and a reversing sensor 27 that serves as a sheet detector are disposed at the junction 17*a* of the pathway 13, which extends from the first direction switching claw 12 toward the duplex sheet inverting device 15, and the one end of the duplex sheet pathway 21. The second direction switching claw 26 is driven by a solenoid. The reversing sensor 27 includes a reflective photosensor, for example, to detect the leading edge and the trailing edge of the one-side printed sheet.

The one end of the duplex sheet pathway 21 corresponds to a lower end thereof and is connected to the reentry slot 18 of the sheet reentry pathway 41 toward the pair of registration rollers 7. A reentry roller 42 is disposed at the sheet reentry pathway 41.

Operations of the duplex reversing device 15 including the above-described components and units are controlled by a control unit that serves as a controller. The control unit is formed of a microcomputer that includes a central processing unit (CPU), a read-only memory (ROM), a random access memory (RAM), an internal timer, an input and output (I/O) port, and the like. The ROM stores fixed data and various processing programs including programs necessary for controlling various drive units. The RAM serves as a data memory to store the processing data. The internal timer serves as a time keeper.

The CPU includes an input port that is connected to the reversing sensor 27, a signal output unit to output various trigger signals, an operation unit, and so forth. The CPU further includes an output port that is connected to a drive motor, an electromagnetic clutch, solenoids, and the like. The drive motor serving as a drive unit drives the first reversing roller 23, the second reversing roller 25, and the duplex sheet conveying roller 24. The solenoids drive the first direction switching claw 12 and the second direction switching claw 26, respectively. The CPU controls the drive motor and the solenoids according to signals transmitted from the revering sensor 27, the trigger signals, and the like.

Figure 2:
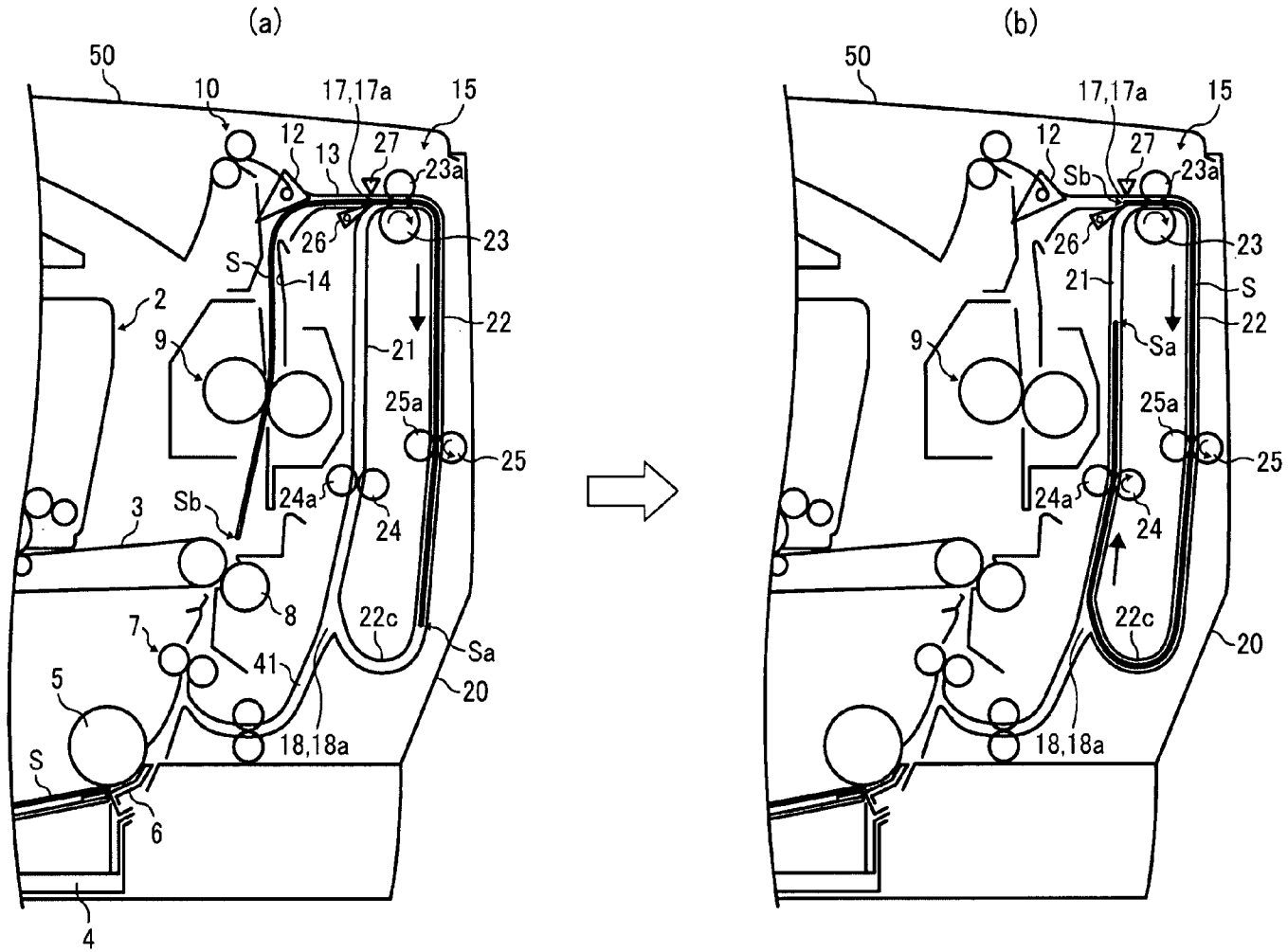
FIGS. 2(*a*) and 2(*b*) are diagrams illustrating states of conveyance of a sheet in the duplex sheet inverting device according to Embodiment 1 of the present invention.

Now, a description is given of operations of automatic duplex printing, in reference to FIGS. 2(*a*), 2(*b*), 3(*a*), and 3(*b*). FIGS. 2(*a*), 2(*b*), 3(*a*), and 3(*b*) illustrate respective sequential states when the automatic duplex printing is performed sequentially to a sheet of an LG size having a length of 355.6 mm that is the maximum sheet size applicable to compact printers such as the printer 100 according to Embodiment 1.

In Embodiment 1 and following embodiments and modifications, the duplex sheet conveying roller 24, the first reversing roller 23, and the second reversing roller 25 serve as drive rollers to move in a forward direction that is same as the above-described sheet conveyance direction to which the sheet is conveyed from upward to downward in the vertical direction Z, and rotate in a rotation direction indicated by arrows in FIGS. 2(*a*), 2(*b*), 3(*a*), and 3(*b*). By contrast, the driven rollers 23*a*, 24*a*, and 25*a* serve as driven rollers and are disposed facing the respective drive rollers 23, 24, and 25.

As partly described above, as illustrated in FIG. 2(*a*), a sheet S is fed from the sheet feeding tray 4 and separated one by one from the other sheets therein by the sheet feed roller 5 and the sheet separation unit 6 to be conveyed to the pair of registration rollers 7.

The sheet S is conveyed and stopped at the pair of registration rollers 7 in synchronization with movement of an image formed by the optical writing device 1 and the image forming unit 2 and transferred onto the intermediate transfer belt 3. The sheet S is then conveyed to the image transfer portion including the image intermediate transfer belt 3 and the secondary transfer roller 8.

After being transferred onto the sheet S at the image transfer portion, the image is fixed to the sheet S in the fixing unit 9. Hereafter, the sheet S having one image on one side thereof is also referred to as "the one-side printed sheet S" or simply as the "sheet S" when clearly distinguished from a two-side printed sheet. In synchronization with the conveyance of the sheet S via the one-side printed sheet pathway 14, the first direction switching claw 12 is driven to pass the sheet S to the pathway 13 for guiding the sheet S to the duplex sheet inverting device 15.

In a case in which a sheet sensor such as a fixing exit sensor and a sheet discharging sensor is disposed at the one-side printed sheet pathway 14 that extends from the fixing unit 9 to the first direction switching claw 12, the first detection switching claw 12 moves to be switched from the an initial position, which is a position to guide the sheet S to the pathway on the side of the pair of sheet discharging rollers 10, to the pathway 13 at a given timing that is triggered by the detection of the leading edge of the sheet S by the sheet sensor. In a compact printer such as the printer 100 according to Embodiment 1, however, a length of a sheet conveyance distance from the sheet sensor to the first direction switching claw 12 is relatively short, and therefore the first detection switching claw 12 cannot be switched timely after the sheet sensor has detected the leading edge of the sheet S. In this case, the control unit causes the position of the first direction switching claw 12 to be switched at a predetermined time according to the start of conveyance of the sheet S from the pair of registration rollers 7 to the image transfer portion.

As illustrated in FIG. 2(*a*), the duplex sheet inverting device 15 conveys the sheet S in a downward direction along the vertical direction Z in the reversing pathway 22 in response to the forward rotation of the first reversing rollers 23 and the second reversing rollers 25. Here, if the length of the sheet S is relatively long, after a leading edge Sa of the sheet S has reached the curved portion 22*c* at the lower end portion of the reversing pathway 22, the sheet S is guided by the curved portion 22*c* as illustrated in FIG. 2(*b*) to enter the duplex sheet pathway 21 via the junction 18*a*, and is conveyed in the duplex sheet pathway 21 from downward to upward along the vertical direction Z. In other words, the sheet S that is inverted in the duplex sheet pathway 21 is conveyed from downward to upward in the sheet conveyance direction. At this time, the duplex sheet conveying roller 24 rotates in the reverse direction to receive the sheet S so that the sheet S travels from downward to upward in the duplex sheet pathway 21 to convey the leading edge Sa of the sheet S further upward.

Then, when the reversing sensor 27 detects a trailing edge Sb of the sheet S as illustrated in FIG. 2(*b*), the first reversing roller 23, the second reversing roller 25, and the duplex sheet conveying roller 24 stop to hold the conveyance of the sheet S performed by the duplex sheet inverting device 15 temporarily. During the period of time in which the rollers 23, 24, and 25 are stopped, the control unit of the duplex sheet inverting device 15 drives the first direction switching claw 12 to move back to the initial position at which the sheet S is guided from the fixing unit 9 to the pathway leading to the pair of sheet discharging rollers 10. At the same time, the control unit of the duplex sheet inverting device 15 drives the second direction switching claw 26 to move to a position to guide the sheet S to the duplex sheet pathway 21, without returning the sheet conveyed from the reversing pathway 22 to the entrance slot 17 of the pathway 13.

Figure 3:
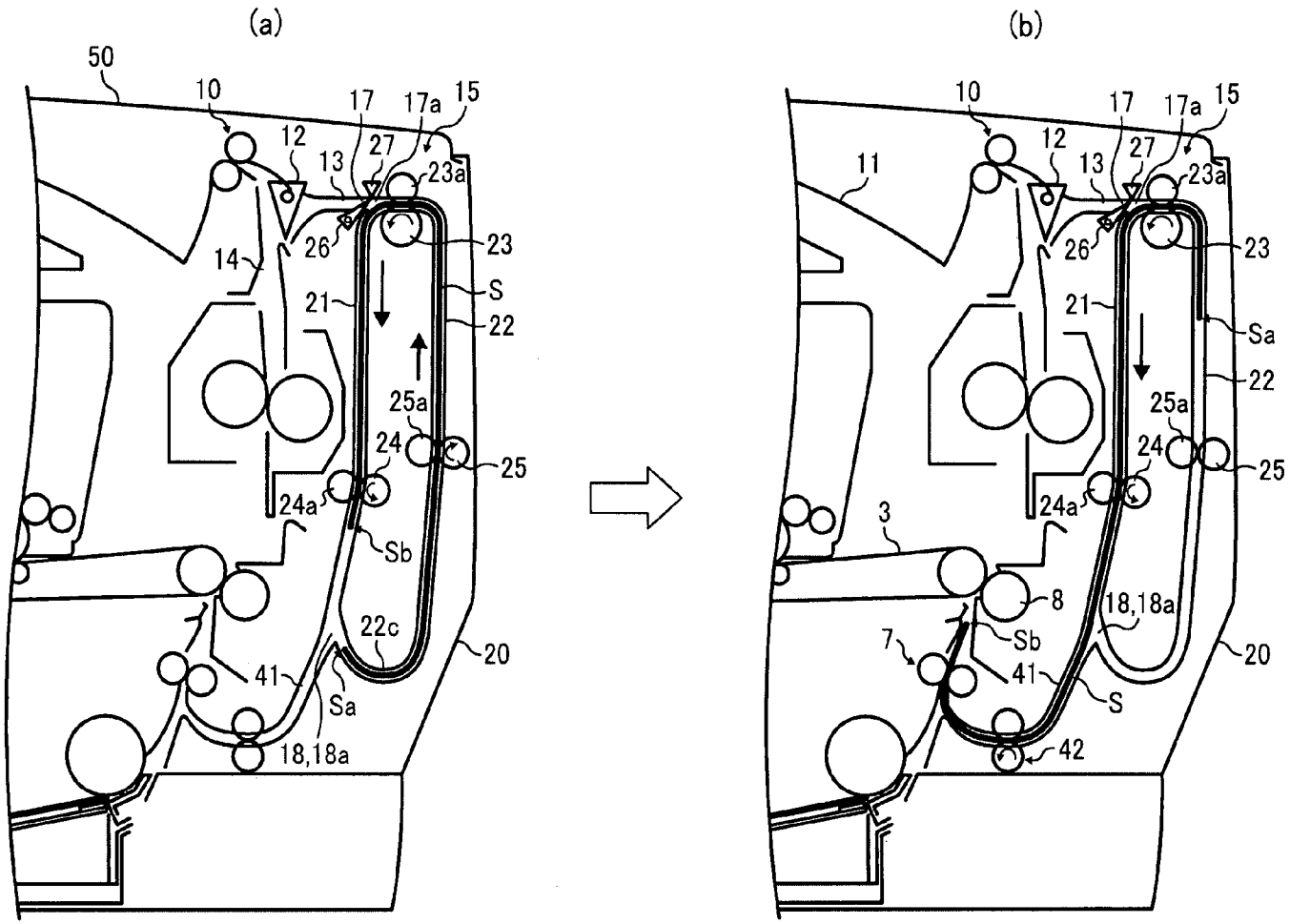
FIGS. 3(*a*) and 3(*b*) are diagrams illustrating states of switchback and reversing of the sheet in the duplex sheet inverting device according to Embodiment 1 of the present invention.

Then, as illustrated in FIG. 3(*a*), the control unit of the duplex sheet inverting device 15 drives the first reversing roller 23 and the second reversing roller 25 in the reverse direction and the duplex sheet conveying roller 24 in the forward direction, so as to change the sheet conveyance direction in the reversing pathway 22 to move the sheet S from downward to upward, that is, in the reverse direction. By conveying the sheet S from downward to upward in the reversing pathway 22, the sheet S is switched back by reversing the orientation of the leading edge Sa and the trailing edge Sb thereof, so that the sheet S can enter the duplex sheet pathway 21 with the trailing edge Sb being conveyed before the leading edge Sa and travels in the vertical direction Z from upward to downward in the duplex sheet pathway 21.

Then, as illustrated in FIG. 3(*b*), the trailing edge Sb of the sheet S passes at the junction 18*a* that is located at the lower end portion of the duplex sheet pathway 21 and enters the sheet reentry pathway 41 having the curved shape. According to rotations of the reentry roller 42 in a direction indicated by arrow in FIG. 3(*b*), the inverted sheet S is conveyed toward the pair of registration rollers 7 with an unprinted surface of the sheet S serving as an opposite side that corresponds to the left side surface of the sheet S at the trailing edge Sb in FIG. 3(*b*) and a printed surface of the sheet S serving as a front side that corresponds to the right side surface of the sheet S at the trailing edge Sb in FIG. 3(*b*). Then, at the pair of registration rollers 7, in synchronization with movement of an image formed on the intermediate transfer belt 3, the unprinted surface of the inverted sheet S is conveyed to the image transfer portion so as to transfer the image formed on the intermediate transfer belt 3 onto the unprinted surface of the opposite side of the inverted sheet S. Then, the inverted sheet S with images on both sides is discharged by the pair of sheet discharging rollers 10 to the sheet discharging tray 11.

As described above, the first reversing roller 23, the second reversing roller 25, and the duplex sheet conveying roller 24 rotate in the forward and reverse directions. Since each of the first reversing roller 23, the second reversing roller 25, and the duplex sheet conveying roller 24 rotate in a constantly identical combination of direction of rotation, these rollers 23, 24, and 25 can be driven by an identical drive motor as a common drive source, and the start and stop of rotation of each roller can be controlled by the electromagnetic clutch. For example when a motor such as a stepping motor controlled by a pulse input drive is used as a drive source, it is obviously possible to easily control the sheet conveyance distance and the switching timing of each sheet conveyance roller and each switching claw associated with the sheet conveyance distance by the pulses accurately.

Here, a description is additionally given of the position setting of the duplex sheet conveying roller 24 in the vertical direction Z in the duplex sheet pathway 21. The position of the duplex sheet conveying roller 24 in the vertical direction Z is set to a position appropriate for gripping the trailing edge Sb of the sheet S to guide and convey the sheet S to the duplex sheet pathway 21 after the sheet S is conveyed to and switched back in the reversing pathway 22. In other words, when the sheet S having a long length is conveyed to the duplex sheet conveying roller 24 of the duplex sheet pathway 21 via the reversing pathway 22, the duplex sheet conveying roller 24 rotates in the forward and reverse directions so at to prevent the leading edge Sa of the sheet S from abutting against the duplex sheet conveying rollers 24 and 24*a* and the trailing edge Sb of the sheet S from abutting against the duplex sheet conveying roller 24 after the sheet S has been switched back.

From the above description, for conveying the sheet S having the minimum length to be inverted in a stable manner at the switchback of the sheet S, it is clear that a sheet conveyance distance from the first reversing roller 23 (e.g., the center of a nip formed between a conveyance roller 31 and a driven roller 33 in Embodiment 2 illustrated in FIG. 9 that is described later) to (the center of the nip of) the duplex sheet conveying roller 24 and another sheet conveyance distance from the center of the nip formed between the duplex sheet conveying roller 24 to the center of a nip formed between the reentry roller 42 need to be shorter than the minimum length of the sheet S.

In Embodiment 1, the duplex sheet conveying roller 24 rotates in the forward and reverse directions. However, if the maximum length of the sheet S to be inverted is not long enough to reach the duplex sheet conveying rollers 24 after the sheet S has entered from the reversing pathway 22 to the duplex sheet pathway 21, the duplex sheet conveying roller 24 can be driven to convey the sheet S only downwardly in the vertical direction Z, and therefore is not necessary to drive in both forward and reverse direction. In addition, the duplex printing is not necessary to perform for the sheet S having a relatively short length, and, when the corresponding sheet size is relatively narrow, it is possible not to dispose the duplex sheet conveying roller 24 between the junctions 17*a* and 18*a* of both ends of the duplex sheet pathway 21 and the reversing pathway 22.

In Embodiment 1, two rollers, which are the first reversing roller 23 and the second reversing roller 25, are provided as the redirectable sheet conveyance members. However, it is not necessary to provide these rollers 23 and 25 but the number of rollers can be determined according to the sheet size range to be applied and used in the duplex sheet inverting device 15.

Figure 4:
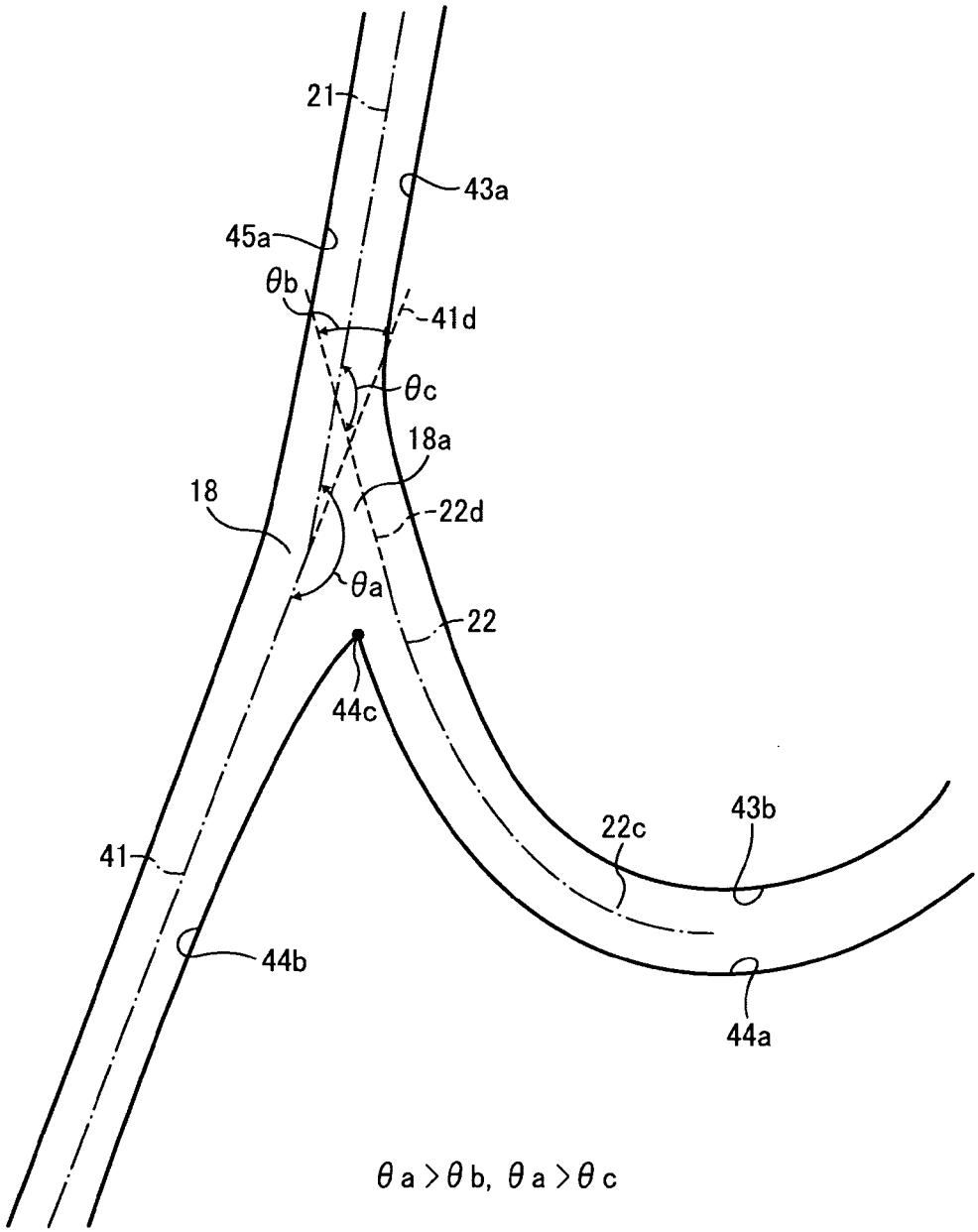
FIG. 4 is a diagram illustrating a comparison of an angle between a reversing pathway and a reentry pathway, an angle between a duplex pathway and the re-entry pathway, and an angle between the duplex pathway and the reversing pathway in the vicinity of the reentry pathway.

Referring to FIG. 4, a description is given of comparison of angles formed in the vicinity of the reentry slot 18.

In the vicinity of the reentry slot 18, an angle θa is formed between the duplex sheet pathway 21 serving as the second pathway and the sheet reentry pathway 41 serving as a reentry pathway and an export pathway, an angle θb is formed between the reversing pathway 22 serving as the first pathway and the sheet reentry pathway 41, and an angle θc is formed between the duplex sheet pathway 21 and the reversing pathway 22. In FIG. 4, reference numeral "22*d*" as illustrated with a broken line represents a plane extended from the center of the reversing pathway 22 and the center of the curved portion 22*c* in the vicinity of the reentry slot 18, and reference numeral "41*d*" illustrated with a broken line represents a plane extended from the center of the sheet reentry pathway 41 in the vicinity of the reentry slot 18.

As can be seen from FIG. 4, the angle θa formed between the duplex sheet pathway 21 and the sheet reentry pathway 41 is beyond 180 degrees and is formed greater than the angle θb formed between the reversing pathway 22 and the sheet reentry pathway 41. Therefore, the configuration according to Embodiment 1 is effective that, when the sheet S is conveyed in the reversing pathway 22 serving as the first pathway in the forward direction (e.g., the clockwise direction), the sheet S can avoid being conveyed to the reentry slot 18 as illustrated in FIG. 5(*a*) and can be conveyed in the duplex sheet pathway 21 serving as the second pathway in the forward direction smoothly as illustrated in FIG. 5(*c*), and that, when the sheet S is conveyed in the duplex sheet pathway 21 serving as the second pathway in the reverse direction (e.g., the counterclockwise direction), the sheet S can be exited from the reentry slot 18 smoothly as illustrated in FIG. 5(*d*).

Further, the angle θa formed between the duplex sheet pathway 21 and the sheet reentry pathway 41 is formed greater than the angle θc formed between the duplex sheet pathway 21 and the reversing pathway 22. Therefore, the configuration according to Embodiment 1 is effective that, when the sheet S is conveyed in the duplex sheet pathway 21 serving as the second pathway in the reverse direction (e.g., the counterclockwise direction), the sheet S cannot return to the reversing pathway 22 serving as the first pathway easily as illustrated in FIG. 5(*b*), and that, when the sheet S is conveyed in the duplex sheet pathway 21 serving as the second pathway in the reverse direction (e.g., the counterclockwise direction) can be exited from the reentry slot 18 smoothly as illustrated in FIG. 5(*d*).

Figure 5:
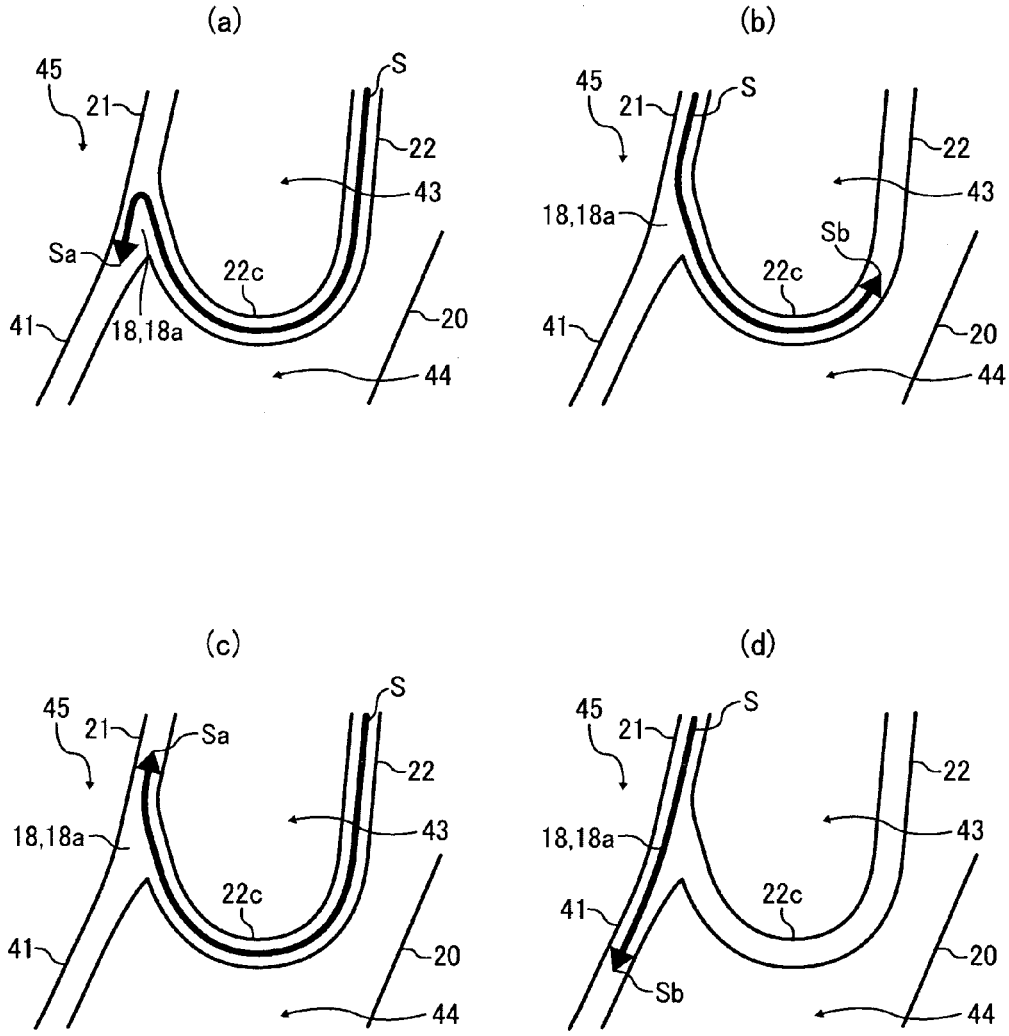
FIGS. 5(*a*) and 5(*b*) are schematic diagrams illustrating abnormal states of the sheet in a curved connecting portion or junction in Embodiment 1, and FIGS. 5(*c*) and 5(*d*) are schematic diagrams illustrating normal states of the sheet in the curved junction in the duplex sheet inverting device according to Embodiment 1.

As described above, the configuration of the duplex sheet inverting device 15 in Embodiment 1 can prevent an abnormal sheet guiding, as illustrated in FIGS. 5(*a*) and 5(*b*) and provide a normal sheet guiding as illustrated in FIGS. 5(*c*) and 5(*d*), without providing a switching claw at the junction 18*a*. Specifically, the configuration of the duplex sheet inverting device 15 in Embodiment 1 employs a method of guiding sheets to move in the sheet conveyance direction at the junction 18*a* using the resilience (rigidity) of sheet. The junction 18*a* is formed to guide the sheet S that travels from the reversing pathway 22 to the duplex sheet pathway 21 upwardly in the vertical direction Z, as illustrated in FIG. 5(*c*), and the sheet S that travels in the duplex sheet pathway 21 downwardly in the vertical direction Z to the sheet reentry pathway 41 without causing the sheet to enter into the reversing pathway 22, as illustrated in FIG. 5(*d*).

Figure 6:
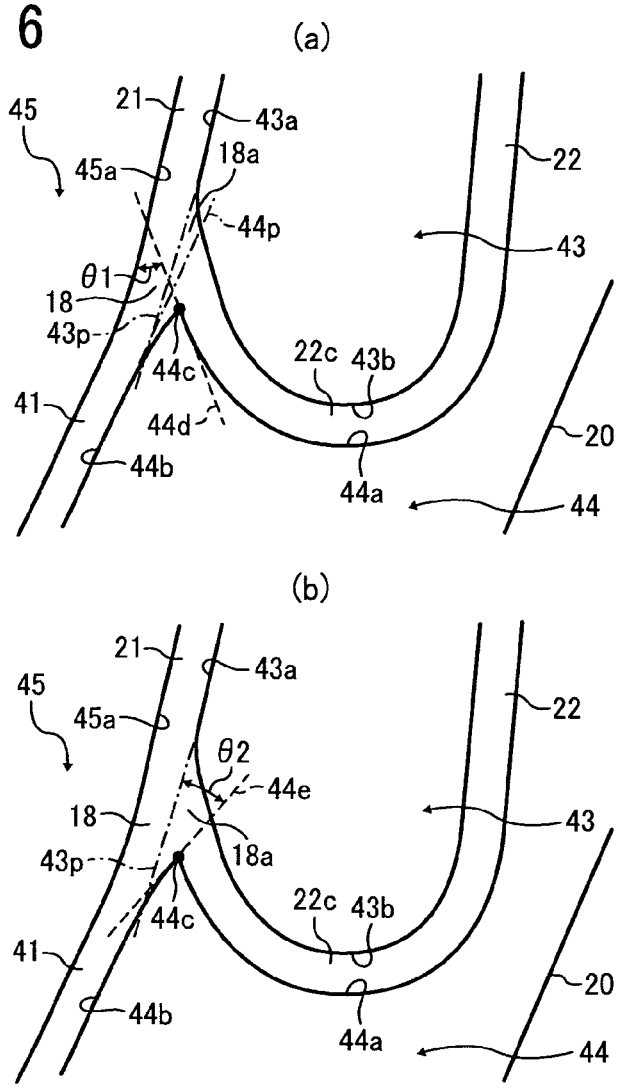
FIGS. 6(*a*) and 6(*b*) are diagrams showing a position and shape of each guide plate forming the curved junction in the duplex sheet inverting device according to Embodiment 1.

Referring to FIGS. 6(*a*) and 6(*b*), an additional description is given of guide members provided in the vicinity of the junction 18*a* to guide the sheet S illustrated in FIGS. 5(*c*) and 5(*d*).

As illustrated in FIGS. 6(*a*) and 6(*b*), an inner curved guide plate 43, an outer curved guide plate 44, and a duplex guide plate 45 are disposed in the vicinity of the junction 18*a* at the other end of the reversing pathway 22 and the one end of the duplex sheet pathway 21.

The inner curved guide plate 43 serves as a first guide member and includes a sheet conveyance guide surface 43*a* that serves as a first conveyance guide surface to define the duplex sheet pathway 21, and a sheet inverting guide surface 43*b* that serves as a first inverting guide surface to define the reversing pathway 22.

The outer curved guide plate 44 serves as a second guide member and includes a sheet inverting guide surface 44*a* that serves a second inverting guide surface and is disposed facing the sheet inverting guide surface 43*b* to define the reversing pathway 22, a sheet reentry guide surface 44*b* that serves as a first reentry guide surface to define the sheet reentry pathway 41, and a peak 44*c* serving as a peak portion at which the sheet inverting guide surface 43*b* and the sheet reentry guide surface 44*b* meet.

The duplex guide plate 45 serves as a third guide member and includes a sheet conveyance guide surface 45*a* that serves as a second conveyance guide surface disposed facing the sheet conveyance guide surface 43*a* to define the duplex sheet pathway 21.

To perform the normal sheet guiding as illustrated in FIGS. 5(*c*) and 5(*d*), the positions and shapes of the inner curved guide plate 43, the outer curved guide plate 44, and the duplex guide plate 45 are determined such that the peak 44*c* is located at a position retreated from an extended plane 43*p*, which is illustrated with a dashed-dotted line, of the sheet conveyance guide surface 43*a* toward the duplex sheet pathway 21 and the sheet reentry pathway 41 and also at a position retreated from an extended plane 44*p*, which is illustrated with a dashed-dotted line, of the sheet reentry guide surface 44*b* toward the duplex sheet pathway 21 and the sheet reentry pathway 41.

At the same time, the positions and shapes of the inner curved guide plate 43, the outer curved guide plate 44, and the duplex guide plate 45 are determined such that an angle θ1 that is formed between the sheet conveyance guide surface 45*a* and a tangential line 44*d*, which is illustrated with a broken line, in the vicinity of the peak 44*c* to the sheet inverting guide surface 44*a* forms an acute angle, as illustrated in FIG. 6(*a*). Further, the positions and shapes of the inner curved guide plate 43, the outer curved guide plate 44, and the duplex guide plate 45 are determined such that an angle θ2 that is formed between the extended plane 43*p* of the sheet conveyance guide surface 43*a* and a tangential line 44*e*, which is illustrated with a broken line, in the vicinity of the peak 44*c* to the sheet reentry guide surface 44*b* forms an acute angle, as illustrated in FIG. 6(*b*).

[Modification 1]

Figure 7:
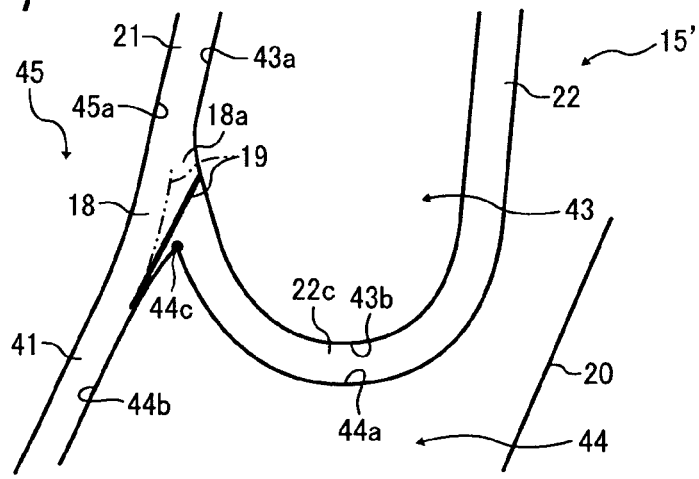
FIG. 7 is a diagram of Modification according to Embodiment 1, showing operations of an elastic guide member disposed at the curved junction in the duplex sheet inverting device.

Now, FIG. 7 illustrates the configuration of a duplex sheet inverting device 15' according to Modification 1 based on the duplex sheet inverting device 15 according to Embodiment 1. The configuration of the duplex sheet inverting device 15' according to Modification 1 is basically same as the configuration of the duplex sheet inverting device 15 according to Embodiment 1. Except, the configuration of the duplex sheet inverting device 15' according to Modification 1 further includes an elastic guide member 19 that is a mylar sheet, for example. As illustrated in FIG. 7, the elastic guide member 19 is provided to make the sheet conveyance direction and the sheet guiding direction at the junction 18*a* more reliable. The elastic guide member 19 functions as a guide member to guide the sheet S that is conveyed in the reverse direction from upward to downward in the duplex sheet pathway 21 to exit from the reentry slot 18, without returning to the reversing pathway 22.

The elastic guide member 19 includes a base end that is fixedly attached to the sheet reentry guide surface 44*b* and an upper end that serves as a free end. In a normal state, the elastic guide member 19 is disposed as illustrated with a solid line to block the sheet S to enter from the reversing pathway 22 to the duplex sheet pathway 21. Consequently, the elastic guide member 19 prevents the sheet S that is conveyed in the vertical direction Z from upward to downward in the duplex sheet pathway 21 from entering the reversing pathway 22 at the junction 18*a*, thereby guiding the sheet S to the sheet reentry pathway 41 reliably.

On the other hand, the leading edge of the sheet S that is conveyed to the junction 18*a* via the curved portion 22*c* of the reversing pathway 22 contacts the free end of the elastic guide member 19 at the junction 18*a*, and therefore the elastic guide member 19 bends due to the resilience (rigidity) of the sheet S, as illustrated with a broken line in FIG. 7. Consequently, the blocked slot of the duplex sheet pathway 21 is opened, so that the elastic guide member 19 can guide the sheet S in the upward direction in the duplex sheet pathway 21 reliably.

As described later, an interleaving duplex printing is performed for a preceding sheet having a long length in the sheet conveyance direction, and therefore, even if a subsequent sheet is conveyed from the reversing pathway 22 to the junction 18*a* while the preceding sheet is traveling in the duplex sheet pathway 21 in a downward direction, the elastic guide member 19 can guide the subsequent sheet in the upward direction of the duplex sheet pathway 21, without giving a large load to the preceding sheet.

To make the sheet conveyance direction and the guiding direction at the junction 18*a* more reliable, it is possible to dispose a switching claw and a separation claw serving as sheet redirecting members to selectively change the pathways, which is same as the first and second sheet redirecting members 12 and 26.

As described above, the configuration of the duplex sheet inverting device 15 according to Embodiment 1 and the configuration of the duplex sheet inverting device 15' according to Modification 1 can invert a sheet having a length longer than the length of the reversing pathway 22, without causing the sheet to appear to the outside of the apparatus or device. Specifically, the configuration of Embodiment 1 can switch back and invert a sheet having the maximum length in the loop pathway 16, and thereby minimizing the duplex sheet inverting device 15 (15') serving as a sheet inverting device and the printer 100.

The printer 100 of Embodiment 1 illustrated in FIG. 1 employs a sheet vertical conveyance type to convey the sheet S from the sheet feeding tray 4 disposed at the lower portion of the main body 50 via the pair of registration rollers 7, the image transfer portion, and the fixing unit 9 to the sheet stacking tray 11 disposed at the upper portion of the main body 50. The position of the pair of sheet discharging rollers 10 is determined according to the height necessary for disposing the sheet feeding tray 4, the sheet forming mechanism 200, the optical writing device 1, and the sheet stacking tray 11 and according to the number of sheets to be loaded on the sheet stacking tray 11. Thus, the height of the printer 100 is required and determined to meet the height sufficient for one-side printing.

To invert the sheet without appearing to the outside of the device during the process of a sheet inverting operation, the height of a sheet inverting device increases. Conventionally, the height of the printer 100 of Embodiment 1 is not sufficient to invert a sheet without causing the sheet to appear to the outside of the device during the process, and therefore the height of a printer needs to be further increased. By contrast, by reducing the height of the duplex sheet inverting device 15, the height of the printer 100 of the vertical sheet conveyance type including the automatic duplex printing function can be reduced more than a conventional printer by a certain degree, details of which will be described below. For example, to invert an LG size sheet without causing the sheet to appear to the outside of the duplex sheet inverting device 15 during the process of the sheet inverting operation, the printer 100 of Embodiment 1 can reduce a length in a range of from approximately 100 mm to approximately 170 mm while a conventional device requires a length same as that of a reversing pathway.

Further, the curved portion 22*c* of the reversing pathway 21 can be extended downwardly within the space H that is a range not extending the maximum length of the sheet to be inverted.

[Modification 2]

Figure 8:
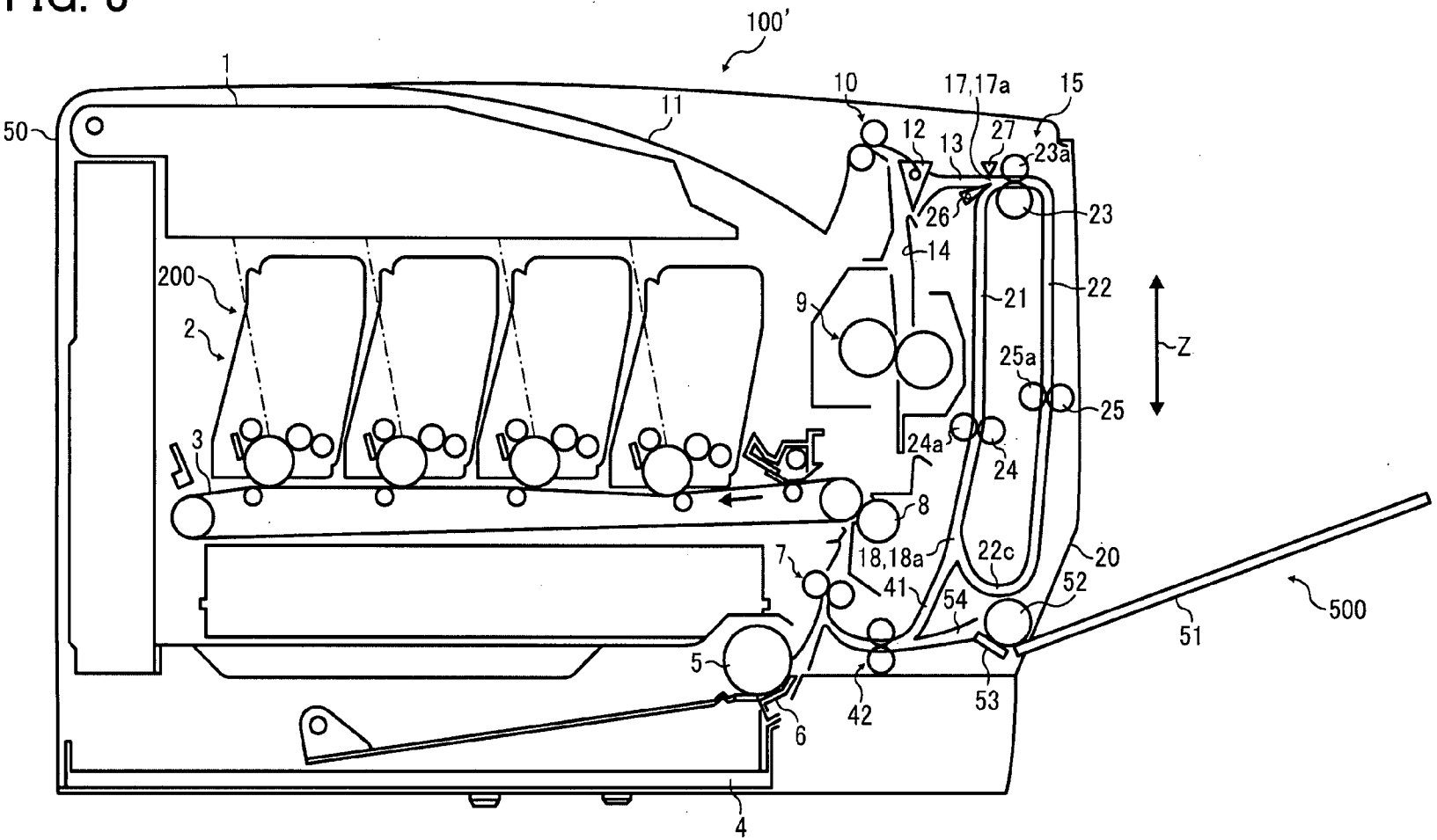
FIG. 8 is a diagram of Modification 2 according to Embodiment 1, showing a schematic configuration of a printer including the duplex sheet inverting device and a manual sheet feeder.

Now, FIG. 8 illustrates a schematic configuration of a printer 100' according to Modification 2 based on the printer 100 according to Embodiment 1. The configuration the printer 100' of Modification 2 is basically same as the configuration of the printer 100 of Embodiment 1. Except, the configuration of the printer 100' of Modification 2 further includes a manual sheet feeding unit 500 at the space H and the cover slope 20.

The configuration of the manual sheet feeding unit 500 is similar to the configuration of a conventional manual sheet feeding unit, and includes a manual sheet tray 51, a manual sheet feed roller 52, a separation pad 53, and a manual sheet feed pathway 54.

A sheet or a top sheet of multiple sheets loaded on the manual sheet tray 51 is fed by the manual sheet feed roller 52, separated by the separation pad 53 from the other sheets, and conveyed via the manual sheet feed pathway 54 to the pair of reentry rollers 42. From the pair of reentry rollers 42, the sheet separated from the other sheets is conveyed via the sheet reentry pathway 41, which is shared with sheets traveling from the duplex sheet pathway 21, to the pair of registration rollers 7.

Thus, a sheet feeding unit such as the manual sheet feeding unit 500 including the manual sheet feed roller 52, the separation pad 53, and so forth can be attached to the space H, thereby minimizing the printer 100' compared to a conventional printer, even if the printer 100' includes the manual sheet feeding unit 500.

Embodiment 2

Referring to FIGS. 9 through 15, descriptions are given of units, components, and operations of a duplex sheet inverting device 35 and a full-color compact printer 100A according to Embodiment 2 of the present invention.

Figure 9:
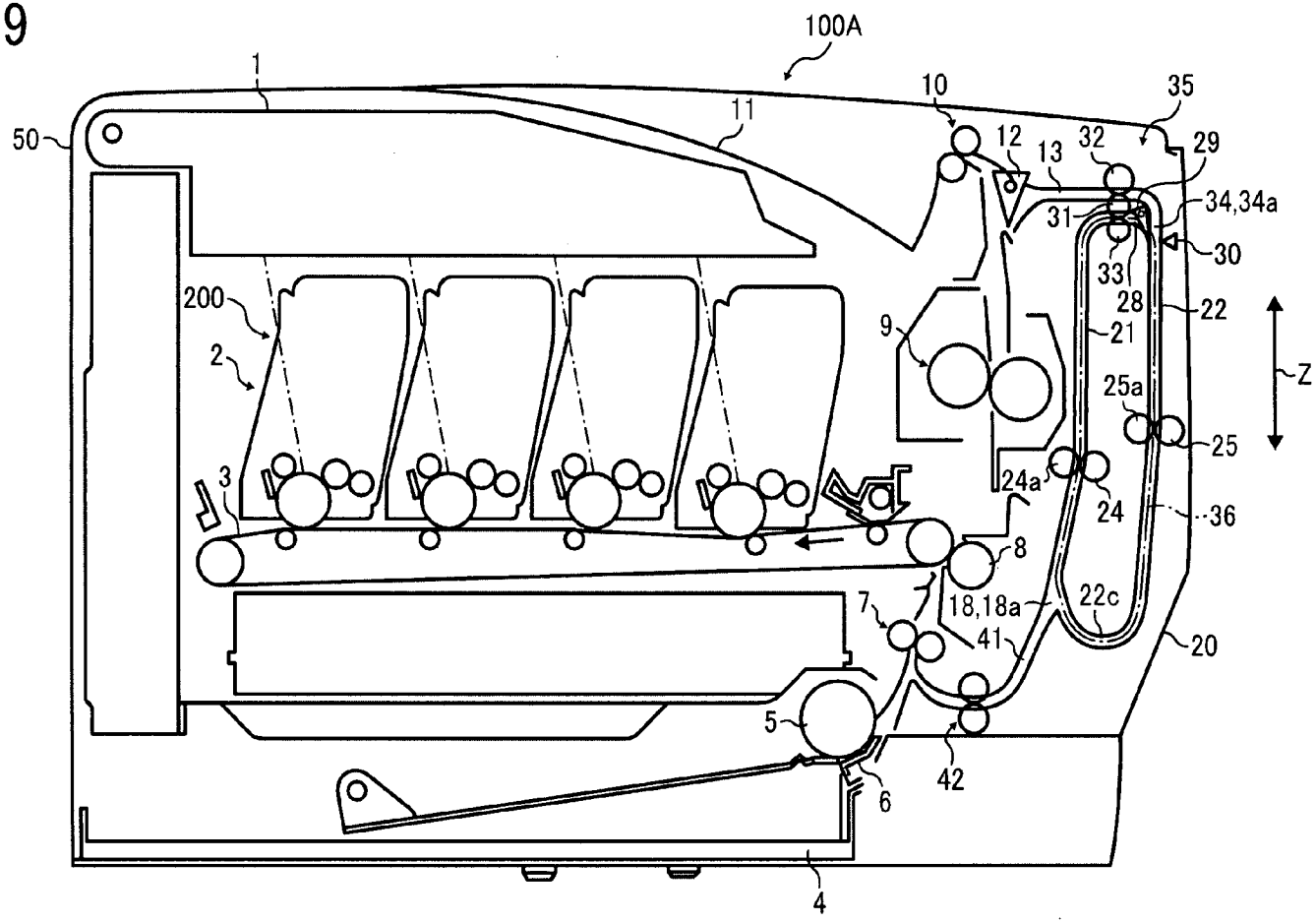
FIG. 9 is a schematic configuration of a printer serving as an image forming apparatus according to Embodiment 2 of the present invention, the printer including a duplex sheet inverting device.

FIG. 9 illustrates a schematic configuration of the printer 100A according to Embodiment 2 of the present invention. The printer 100A includes the duplex sheet inverting device 35 according to Embodiment 2 of the present invention.

As illustrated in FIG. 9, the configuration of the printer 100A according to Embodiment 2 is similar to the configuration of the printer 100 according to Embodiment 1 as described above. Except, while the printer 100 according to Embodiment 1 includes the duplex sheet inverting device 15, Embodiment 2 includes the duplex sheet inverting device 35 that serves as a sheet inverting device. Elements or components of the printer 100A according to Embodiment 2 may be denoted by the same reference numerals as those of the printer 100 according to Embodiment 1 and the descriptions thereof are omitted or summarized.

The duplex sheet inverting device 35 is different from the duplex sheet inverting device 15 as illustrated in FIG. 1, mainly in the following structures:

Instead of the entrance slot 17 and the junction 17*a* provided in the duplex sheet inverting device 15, the duplex sheet inverting device 35 includes an entrance slot 34 for the pathway 13 into which the one-side printed sheet enters, and a connecting point or a junction 34*a* at which the one end of the reversing pathway 22 is connected to the entrance slot 34;

The duplex sheet inverting device 35 includes a pathway 28 to which the other end of the duplex sheet pathway 21 is connected;

The other end of the duplex sheet pathway 21 is connected and merged to the reversing pathway 22 at the junction 34*a* that is located downstream from the one end of the reversing pathway 22 via the pathway 28 in the forward direction;

Instead of the first reversing roller 23 and the driven roller 23*a* disposed at the junction 17*a* provided in the duplex sheet inverting device 15, the duplex sheet inverting device 35 includes one conveyance roller 31 and two driven rollers 32 and 33 that are rotated with the conveyance roller 31, and the conveyance roller 31 and the driven roller 32 are disposed at the pathway 13 and the conveyance roller 31 and the driven roller 33 are disposed at the pathway 28;

Instead of the second direction switching claw 26 provided in the duplex sheet inverting device 15, the duplex sheet inverting device 35 includes a second direction switching claw 29;

Instead of the reversing sensor 27 provided in the duplex sheet inverting device 15, the duplex sheet inverting device 35 includes a reversing sensor 30; and Instead of the loop pathway 16 provided in the duplex sheet inverting device 15, the duplex sheet inverting device 35 includes a loop pathway 36. The long and narrow loop pathway 36 as illustrated with a dashed-dotted line in FIG. 9 includes the reversing pathway 22 and the duplex sheet pathway 21 and extends in the vertical direction Z. The other end of the reversing pathway 22 is curved upward and outward, and is connected to the one end of the duplex sheet pathway 21 in Embodiment 2.

In other words, the loop pathway 36 includes the entrance slot 34 to which a sheet comes in and the reentry slot 18 serving as an exit slot from which the sheet goes out. The loop pathway 36 is shaped to convey the sheet in a loop manner in the direction of conveyance of the sheet entered from the entrance slot 34 as a forward direction (a clockwise direction in FIG. 9). By defining the direction of conveyance of the sheet to be entered from the entrance slot 34 as the forward direction, the loop pathway 36 can be defined as a pathway that includes the reversing pathway 22 serving as the first pathway that runs or extends from the entrance slot 34 to the reentry slot 18 to convey the sheet therethrough in the forward direction and the duplex sheet pathway 21 serving as the second pathway that includes the pathway 28 and runs or extends from the reentry slot 18 to the entrance slot 34 to convey the sheet therethrough in the forward direction.

Other than the above-described differences, the configuration of the duplex sheet inverting device 35 illustrated in FIG. 9 is basically same as the configuration of the duplex sheet inverting device 15 illustrated in FIG. 1. Same as the duplex sheet inverting device 15, the duplex sheet inverting device 35 includes the reversing pathway 22, the duplex sheet pathway 21, the duplex sheet conveying roller 24 disposed at the duplex sheet pathway 21 and serving as sheet conveying members, and the second reversing roller 25 serving as a redirectable sheet conveyance member.

Also same as the duplex sheet inverting device 15 according to Embodiment 1, the switchback operation and the sheet reversing operation to change the orientation of the leading edge and the trailing edge of the one-side printed sheet can be performed in the loop pathway 36 of the duplex sheet inverting device 35 according to Embodiment 2.

The pathway 28 is formed at the other end or the upper end of the duplex sheet pathway 21 in FIG. 9. The other end of the duplex sheet pathway 21 is connected and merged via the pathway 28 to the reversing pathway 22 that is located below the pathway 13 and downstream from the one end of the reversing pathway 22 in the forward direction, and consequently, the junction 34*a* is formed. The sheet to be switched back to the duplex sheet pathway 21 is conveyed form the reversing pathway 22 via the connecting portion 34*a* and the pathway 28.

The pathway 13 and the pathway 28 are disposed closely, one above the other, in the vertical direction Z, and the conveyance roller 31 that is served as a drive member is disposed between the pathway 13 and the pathway 28. Specifically, the conveyance roller 31 is disposed at the pathway 13 and the pathway 28, and the driven rollers 32 and 33 that serve as driven members to rotate with the conveyance roller 31 contact the pathways 13 and 28, respectively, so that the sheet passing through the pathway 13 and the sheet passing through the pathway 28 are simultaneously conveyed in opposite directions to each other. The conveyance roller 31 and the driven rollers 32 and 33, corresponding to a three roller member group, serve as simultaneous sheet conveying members to convey a one-side printed sheet that is conveyed from the reversing pathway 22 via the entrance slot of the pathway 13 and the sheet that is switched back from the reversing pathway 22 via the connecting portion 34*a* of the duplex sheet pathway 21 to the pathway 28 in opposite directions to each other simultaneously.

The second direction switching claw 29 serving as the second switching member is disposed at the junction 34 of the pathway 28 and the reversing pathway 22. The second direction switching claw 29 switches the guiding direction and the pathway for the sheet between when the sheet is conveyed from the pathway 13 to the reversing pathway 22 and when the sheet that is switched back at the reversing pathway 22 is conveyed to the pathway 28. The second direction switching claw 29 is driven by a solenoid that is controlled by a control unit described below.

The reversing sensor 30 is disposed below the junction 34 between the reversing pathway 22 and the pathway 28.

The reversing sensor 30 includes a reflective photosensor, for example, to detect the leading edge and the trailing edge of the one-side printed sheet.

Same as the operations of the duplex sheet inverting device 15 according to Embodiment 1, operations of the duplex sheet inverting device 35 according to Embodiment 2, including the above-described components and units, are controlled by the control unit that serves as a controller. Specifically, the control unit is formed of a microcomputer that includes a central processing unit (CPU), a read-only memory (ROM), a random access memory (RAM), an internal timer serving as a timer keeper, an input and output (I/O) port, and the like.

The CPU includes an input port that is connected to the reversing sensor 30, a signal output unit to output various trigger signals, an operation unit, and so forth. The CPU further includes an output port that is connected to a drive motor, an electromagnetic clutch, solenoids, and the like. The drive motor serving as a drive unit drives the second reversing roller 25, and the duplex sheet conveying roller 24. The respective solenoids drive the first direction switching claw 12 and the second direction switching claw 29. The CPU controls the drive motor and the solenoids according to signals transmitted from the revering sensor 30, the trigger signals, and the like.

Now, a description is given of operations of the duplex sheet inverting device 35 according to Embodiment 2 for interleaving duplex printing, in reference to FIGS. 10 through 15. In the interleaving duplex printing, when the duplex printing is performed to multiple sheets sequentially, the front side of a following sheet (hereinafter, a "subsequent sheet") is printed while the front and opposite sides of one preceding sheet (hereinafter, a "preceding sheet"). By printing the subsequent sheet while the preceding sheet with the first image printed on a front side thereof is being inverted, the productivity of duplex printing can be enhanced.

FIGS. 10 through 15 illustrate sequentially different states when the interleaving duplex printing is performed sequentially to a sheet of an LG size having a length of 355.6 mm that is the maximum sheet size applicable to general compact printers such as the printer 100A according to Embodiment 2.

The initial operation of the interleaving duplex printing according to Embodiment 2 is same as the automatic duplex printing according to Embodiment 1. That is, as illustrated in FIG. 10, a preceding sheet S1 illustrated with a thick, solid line is fed from the sheet feeding tray 4 and separated one by one form the other sheets therein by the sheet feed roller 5 and the sheet separation unit 6 to be conveyed to the pair of registration rollers 7.

The preceding sheet S1 is conveyed and stopped at the pair of registration rollers 7 in synchronization with movement of an image formed by the optical writing device 1 and the image forming unit 2 and transferred onto the intermediate transfer belt 3. The preceding sheet S1 is then conveyed to the image transfer portion including the image intermediate transfer belt 3 and the secondary transfer roller 8.

After being transferred onto the preceding sheet S1 at the image transfer portion, the image is fixed to the preceding sheet S1 in the fixing unit 9. In synchronization with the conveyance of the preceding sheet S1 via the one-side printed sheet pathway 14, the first direction switching claw 12 is driven to pass the preceding sheet S1 to the pathway 13 for guiding the preceding sheet S1 to the duplex sheet inverting device 35.

Figure 10:
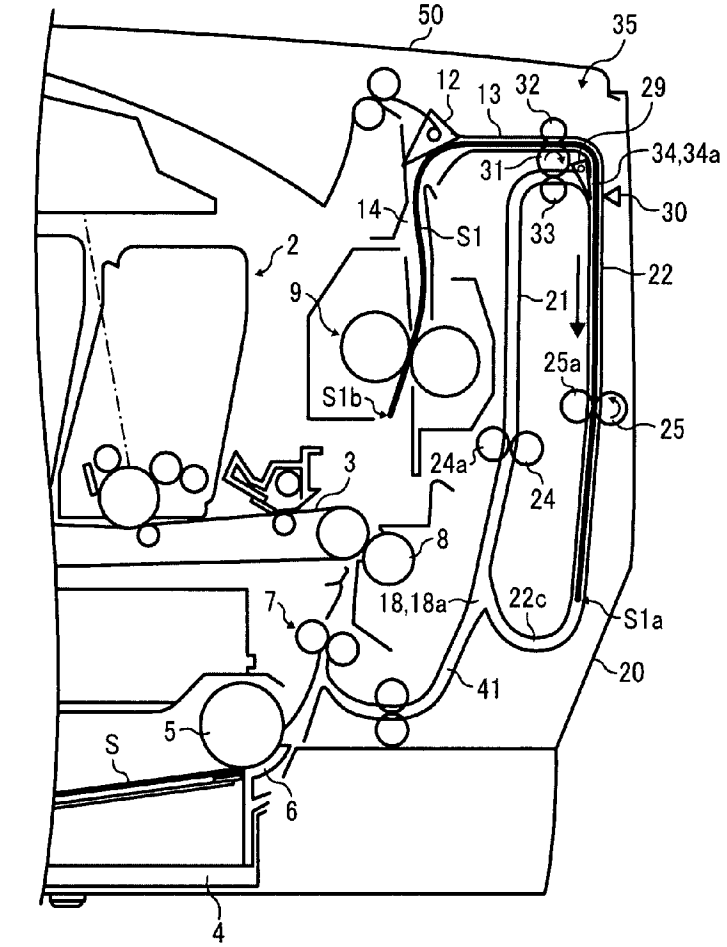
FIG. 10 is an operation diagram showing a state of conveyance of a sheet in the duplex sheet inverting device according to Embodiment 2.

At this time, the conveyance roller 31 is rotated in a direction indicated by arrow as illustrated in FIG. 10 (e.g., the clockwise direction). By so doing, the preceding sheet S1 is conveyed from the pathway 13 to the reversing pathway 22, and further to the second reversing roller 25. In this case, as illustrated in FIG. 10, the duplex sheet inverting device 35 conveys the preceding sheet S1 downwardly in the vertical direction Z in the reversing pathway 22 in response to the forward rotation of second reversing roller 25.

Figure 11:
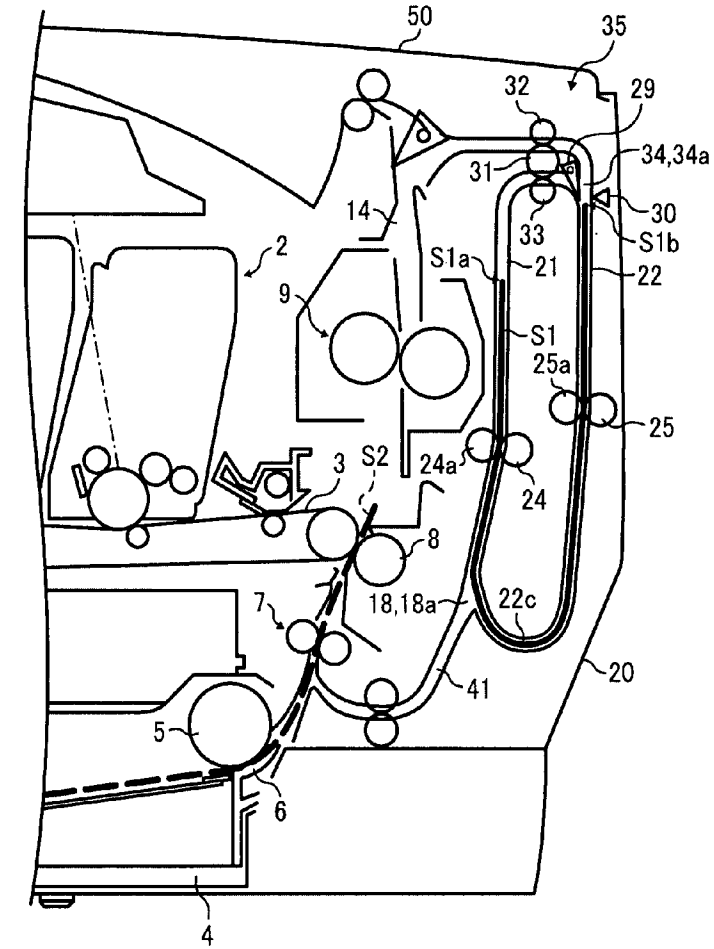
FIG. 11 is an operation diagram showing a state of conveyance of first and second sheets in the duplex sheet inverting device according to Embodiment 2.

In a case in which the length of the preceding sheet S1 is relatively long, after a leading edge S1*a* of the preceding sheet S1 has reached the curved portion 22*c* at the lower end portion of the reversing pathway 22, the preceding sheet S1 is guided by the curved portion 22*c* to enter the duplex sheet pathway 21 via the junction 18*a*, and is conveyed in the duplex sheet pathway 21 from downward to upward along the vertical direction Z, as illustrated in FIG. 11. In other words, the preceding sheet S1 that is turned over in the duplex sheet pathway 21 is conveyed from downward to upward in the sheet conveyance direction of the preceding sheet S1. At this time, the duplex sheet conveying roller 24 rotates in the reverse direction to receive the preceding sheet S1 so from downward to upward so that the preceding sheet S1 travels from downward to upward in the duplex sheet pathway 21 to convey the leading edge S1*a* of the preceding sheet S1 further upward.

Then, when the reversing sensor 30 detects a trailing edge S1*b* of the preceding sheet S1, the second reversing roller 25 and the duplex sheet conveying roller 24 stop to hold the conveyance of the preceding sheet S1 in the duplex sheet inverting device 35 temporarily. During the period of time in which the rollers 24 and 25 are stopped, the control unit of the duplex sheet inverting device 35 feeds a subsequent sheet S2, which is illustrated with a thick, broken line in FIG. 11, from the sheet feeding tray 4. The subsequent sheet S2 fed from the sheet feeding tray 4 is conveyed via the pair of registration rollers 7 to the image transfer portion, at which the subsequent sheet S2 waits until a predetermined time elapses.

After the predetermined time has passed and further conveyance of the subsequent sheet S2 is ready, the control unit of the duplex sheet inverting device 35 drives the second direction switching claw 29 to move to a position at which the subsequent sheet S1 is guided from the reversing pathway 22 to the pathway 28. According to the above-described action of the second direction switching claw 29, the duplex sheet inverting device 35 can start conveying the preceding sheet S1 standing by in the reversing pathway 22 and the duplex sheet pathway 21 in the reverse direction. The above-described predetermined time corresponds to a time in which, after the start of conveyance of the subsequent sheet S2 from the pair of registration rollers 7 to the image transfer portion, a length of the subsequent sheet S2 from a junction of a pathway that extends from the sheet feeding tray 4 to the pair of registration rollers 7 and the sheet reentry pathway 41 to the upward side or toward the sheet feeding tray 4 becomes equal to a length of the preceding sheet S1 to be conveyed during a sum of a conveyance time from which the preceding sheet S1 standing by at a standby position in the duplex sheet inverting device 35 moves from the standby position to which the preceding sheet S1 reaches the junction of the pathway from the sheet feeding tray 4 to the pair of registration rollers 7 and the sheet reentry pathway 41 and a time required to space the subsequent sheet S2 and the preceding sheet S1 for printing the opposite side. In other words, the inverted preceding sheet S1 is started to move in the reverse direction at a timing in which the inverted preceding sheet S1 does not reach the subsequent sheet S2 that is being fed from the sheet feeding tray 4. The timing is determined based on the sheet size (length) information, the elapsed time from when the pair of registration rollers 7 starts to drive to convey the sheet to the image transfer portion, the sheet conveyance speed of the pair of registration rollers 7, the sheet conveyance speeds of the second reversing roller 25 and the duplex sheet conveying roller 24, the length of the sheet conveyance pathway, and so forth.

Figure 12:
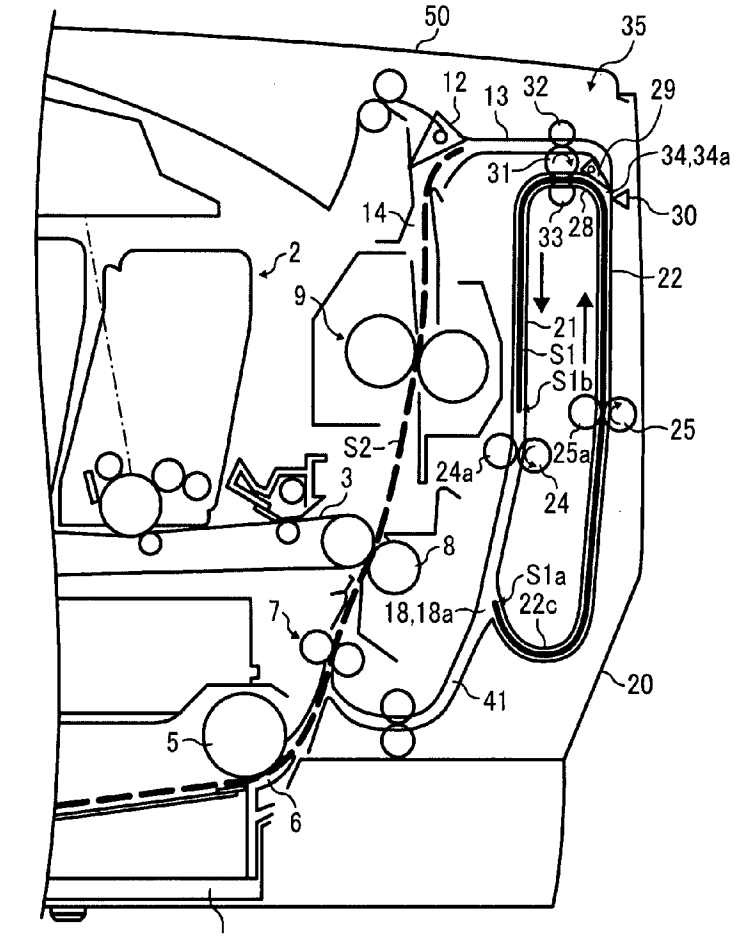
FIG. 12 is an operation diagram showing a state of switchback and reversing of the first and second sheets in the duplex sheet inverting device according to Embodiment 2.

Then, as illustrated in FIG. 12, as the second reversing roller 25 is rotated in the reverse direction, the preceding sheet S1 is conveyed upwardly through the reversing pathway 22. At the same time, the duplex sheet conveying roller 24 is started to rotate in the forward direction, and therefore the preceding sheet S1 is conveyed downwardly through the duplex sheet pathway 21. According to the above-described operations, the preceding sheet S1 is switched back to reverse the orientation of the leading edge S1*a* and the trailing edge S1*b* of the preceding sheet S1 in the sheet conveyance direction. Specifically, the trailing edge S1*b* (the leading edge thereof when viewed in the conveyance direction) of the preceding sheet S1 is conveyed first from the reversing pathway 22 via the pathway 28 to the duplex sheet pathway 21, so as to convey the preceding sheet S1 from upward to downward in the duplex sheet pathway 21.

Here, when the length of the preceding sheet S1 is relatively short, the control unit of the duplex sheet inverting device 35 drives the second switching claw 29 to move back to the position for receiving the subsequent sheet S2 from the pathway 13 to the reversing pathway 22 after the reversing sensor 30 has detected the trailing edge S1*b* of the preceding sheet S1. By contrast, when the length of the preceding sheet S1 is relatively long, the control unit of the duplex sheet inverting device 35 drives the second switching claw 29 to move back to the position for receiving the subsequent sheet S2 from the pathway 13 to the reversing pathway 22 before the subsequent sheet S2 travels from the pathway 13 to enter the reversing pathway 22. At this time, the leading edge S1*a* of the preceding sheet S1 may not be completely exited from the reversing pathway 22. However, since the second switching claw 29 has sufficient space at the position for receiving the preceding sheet S1 from the pathway 13 to the reversing pathway 22 (for example, refer to FIG. 13) for rotatably changing the position, a conveyance path of the preceding sheet S1 from the reversing pathway 22 to the pathway 28 is not blocked completely, and consequently the conveyance of the preceding sheet S1 from the reversing pathway 22 to the duplex sheet pathway 21 can be continued without any difficulty.

Figure 13:
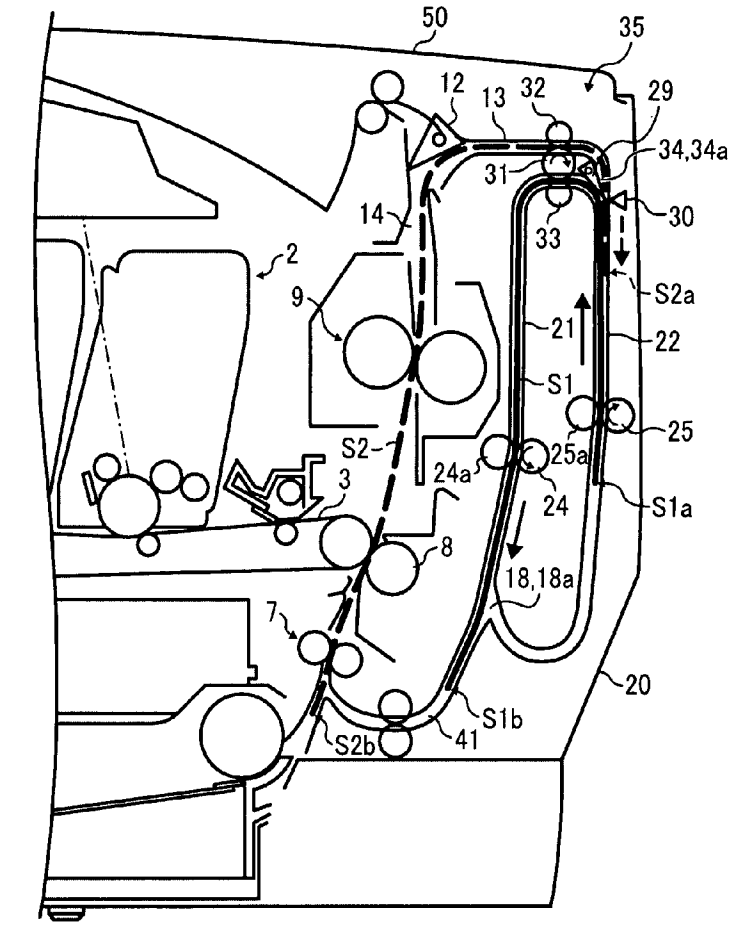
FIG. 13 is an operation diagram showing a state of another switchback and reversing of the first and second sheets in the duplex sheet inverting device according to Embodiment 2.

The subsequent sheet S2 is guided by the first direction switching claw 12 to the pathway 13. As the conveyance roller 31 rotates in a direction indicated by arrow as illustrated in FIG. 13, that is, the clockwise direction, the subsequent sheet S2 is conveyed to the reversing pathway 22. At this time, when the subsequent sheet S2 has a relatively long length and the leading edge S1*a* of the preceding sheet S1 has not been completely exited from the reversing pathway 22, the preceding sheet S1 passes by the subsequent sheet S2 at the upper portion of the second reversing roller 25 in the reversing pathway 22, as illustrated in FIG. 13. However, the plane surface of the preceding sheet S1 only slidably contacts the leading edge S2*a* of the subsequent sheet S2, and therefore the preceding sheet S1 and the subsequent sheet S2 can be continuously conveyed without causing a paper jam, etc.

After the leading edge S1*a* of the preceding sheet S1 has passed through the second reversing roller 25, the control unit causes the second reversing roller 25 to change the direction of rotation from the reverse direction to the forward direction so as to receive the subsequent sheet S2 to convey downwardly. The control unit calculates and determines a timing to reverse the direction of rotation of the second reversing roller 25 from the reverse direction to the forward direction, based on, for example, the elapsed time from when the second reversing roller 25 is started to rotate in the reverse direction to convey the preceding sheet S1 upwardly in the reversing pathway 22, the number of pulses (steps) of a stepping motor that drives the second reversing roller 25, the length of the sheet, the distance from the reversing sensor 30 to the second reversing roller 25, and the sheet conveyance speed.

Figure 14:
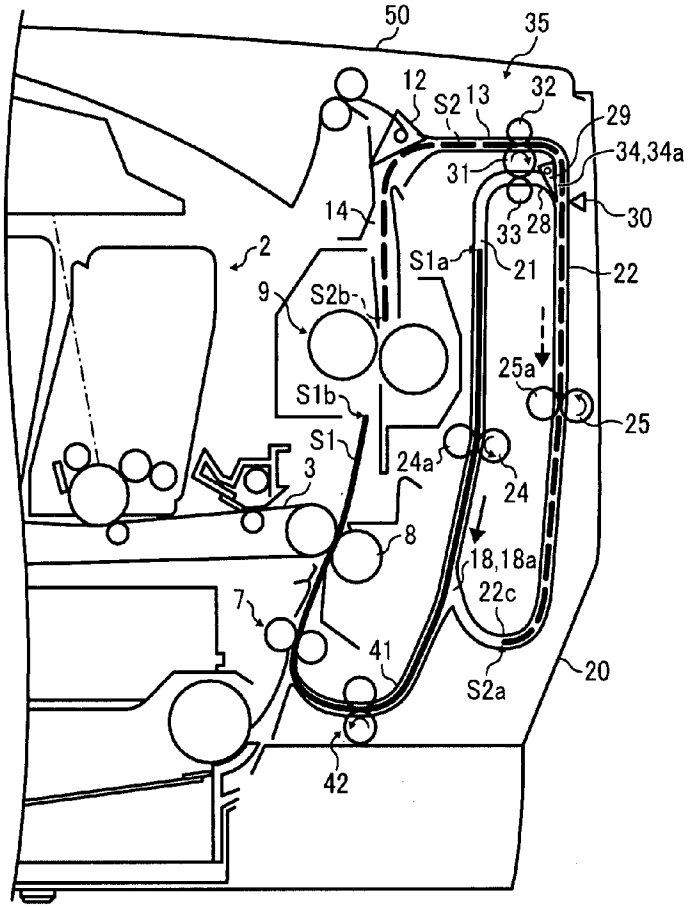
FIG. 14 is an operation diagram showing a state of yet another switchback and reversing of the first and second sheets in the duplex sheet inverting device according to Embodiment 2.

Next, as illustrated in FIG. 14, the preceding sheet S1 passes the junction 18*a* that is located at the lower end portion of the duplex sheet pathway 21 and enters the sheet reentry pathway 41 having the curved shape. According to the rotation of the reentry roller 42 in a direction indicated by arrow in FIG. 14, the inverted preceding sheet S1 is conveyed to the pair of registration rollers 7. At this time, an unprinted surface of the inverted preceding sheet S1 serves as an opposite side that corresponds to the left side surface of the preceding sheet S1 at the trailing edge S1*b* in FIG. 14 and a printed surface of the inverted preceding sheet S1 serves as a front side that corresponds to the right side surface of the preceding sheet S1 at the trailing edge S1*b* in FIG. 14. Then, at the pair of registration rollers 7, in synchronization with movement of an image formed on the intermediate transfer belt 3, the unprinted surface or the opposite side of the preceding sheet S1 is conveyed to the image transfer portion, so as to transfer the image formed on the intermediate transfer belt 3 onto the unprinted surface of the inverted preceding sheet S1. In response to rotations of the conveyance roller 31 and the second reversing roller 25 in respective directions indicated by respective arrows illustrated in FIG. 14, the leading edge S2*a* of the subsequent sheet S2 is guided to the curved portion 22*c* at the lower end portion of the reversing pathway 22 toward the duplex sheet pathway 21, as illustrated in FIG. 14.

Figure 15:
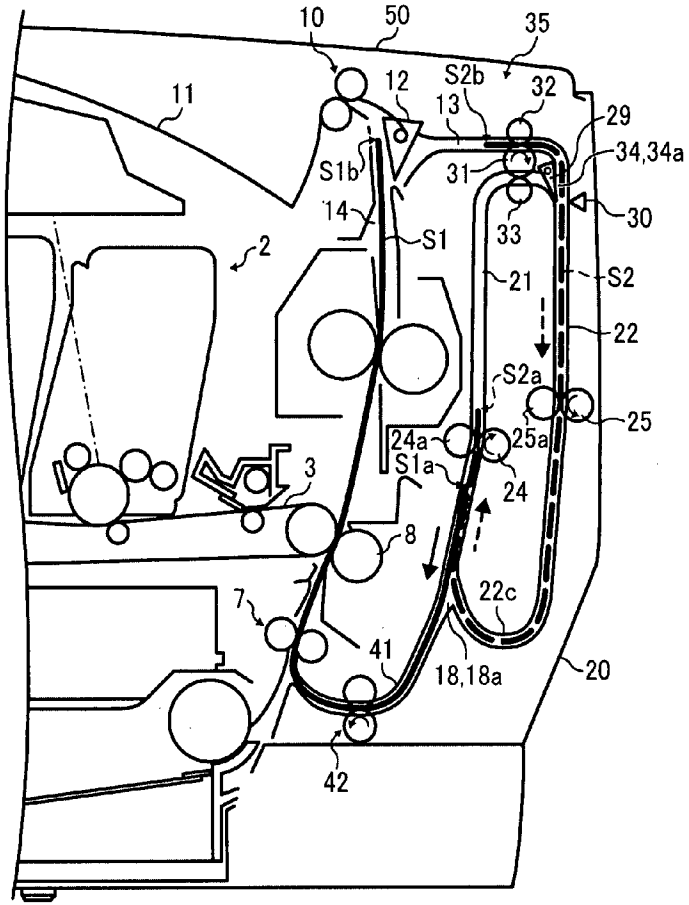
FIG. 15 is an operation diagram showing a state of yet another switchback and reverse of the first and second sheets in the duplex sheet inverting device according to Embodiment 2.

Next, as illustrated in FIG. 15, the subsequent sheet S2 guided by the curved portion 22*c* at the lower end portion of the reversing pathway 22 travels upwardly in the duplex sheet pathway 21. When the subsequent sheet S2 has a relatively long length, the subsequent sheet S2 passes by the leading edge S1*a* of the preceding sheet S1 in the duplex sheet pathway 21, at the lower portion from the duplex sheet conveying roller 24. However, the plane surface of the preceding sheet S1 only slidably contacts the leading edge S2*a* of the subsequent sheet S2, and therefore the preceding sheet S1 and the subsequent sheet S2 can be continuously conveyed without causing a paper jam, etc.

After the leading edge S1*a* of the preceding sheet S1 has passed through the duplex sheet conveying roller 24, the control unit causes the duplex sheet conveying roller 24 to change the direction of rotation from the forward direction to the reverse direction so as to receive the subsequent sheet S2 to convey the leading edge S2*a* of the subsequent sheet S2 upwardly.

The control unit calculates and determines a timing to reverse the direction of rotation of the duplex sheet conveying roller 24 from the forward direction to the reverse direction, based on, for example, the elapsed time from when the leading edge S1*a* of the preceding sheet S1 is detected by the reversing sensor 30, the number of pulses (steps) of a stepping motor that drives the duplex sheet conveying roller 24, the length of the sheet, the distance from the reversing sensor 30 to the duplex sheet conveying roller 24, and the sheet conveyance speed.

After the preceding sheet S1 has been conveyed from the pair of registration rollers 7 to the image transfer portion and started printing an image on the opposite side thereof, the first direction switching claw 12 is driven, between the trailing edge S2*b* of the subsequent sheet S2 that is entering the reversing pathway 22 and the trailing edge S1*b* of the preceding sheet S1 onto the opposite side of which an image is being printed, to move to a position for guiding the preceding sheet S1 from the fixing unit 9 to the pair of sheet discharging rollers 10. Then, the preceding sheet S1 with image on both sides is discharged through the pair of sheet discharging rollers 10 to the sheet stacking tray 11. The moment the reversing sensor 30 detects the trailing edge S2*b* of the subsequent sheet S2, the control unit temporarily stops driving the second reversing roller 25 and the duplex sheet conveying roller 24 and stands by until the elapse of a predetermined period of time after a further subsequent sheet following the subsequent sheet S2 is fed from the sheet feeding tray 4 to start traveling from the pair of registration rollers 7 to the image transfer portion (refer to the state illustrated in FIG. 11).

The above-described operations are repeatedly performed by the number of sheets to be fed for duplex printing.

In Embodiment 2, the second reversing roller 25 and the duplex sheet conveying roller 24 rotate in the forward and reverse directions. There are three applicable combinations of rotations of the second reversing roller 25 and the duplex sheet conveying roller 24, which are a combination of the forward rotation of the second reversing roller 25 and the forward rotation of the duplex sheet conveying roller 24, a combination of the forward rotation of the second reversing roller 25 and the reverse rotation of the duplex sheet conveying roller 24, and a combination of the reverse rotation of the second reversing roller 25 and the forward rotation of the duplex sheet conveying roller 24. To control the above-described rotations, one drive source is not enough to drive the second reversing roller 25 and the duplex sheet conveying roller 24. Various possible driving methods can be applied to drive the second reversing roller 25 and the duplex sheet conveying roller 24. For example, the second reversing roller 25 and the duplex sheet conveying roller 24 are driven by respective dedicated drive motors such as stepping motors to drive respective rollers 24 and 25. For another example, two drive sources of a motor to drive the conveyance roller 31 and a motor to drive the reentry roller 42 are provided for transmitting respective powers to the second reversing roller 25 and the duplex sheet conveying roller 24, and the electromagnetic clutch or the like controls and determines from which drive source the power is transmitted respectively to the second reversing roller 25 and the duplex sheet conveying rollers 24, so as to change the direction of rotation of the rollers 24 and 25.

The above-described Modifications 1 and 2 are also applicable for Embodiment 2. However, in a case in which a sheet redirecting member such as a separation claw and a switching claw is disposed at the junction 18*a* in Embodiment 2, when the interleaving duplex printing is performed as described above, the preceding sheet S1 may pass by the subsequent sheet S2 at or in the vicinity of the junction 18*a*, and therefore the separation claw, for example, needs to be positioned appropriately. That is, it is necessary that the position of the separation claw is set, at the position where the separation claw guides the sheet conveyed from the reversing pathway 22 to the junction 18*a* to the duplex sheet pathway 21 to convey upwardly, such that the separation claw does not block the duplex sheet pathway 21 to convey the sheet in the downward direction therethrough and such that a large load is not given to the sheet that travels downwardly in the duplex sheet pathway 21.

Here, a description is additionally given of the position setting of the duplex sheet conveying roller 24 in the vertical direction Z in the duplex sheet pathway 21 according to Embodiment 2.

The duplex sheet conveying roller 24 of Embodiment 2 in the vertical direction Z is positioned according to a substantially same concept as that of Embodiment 1. That is, the duplex sheet conveying roller 24 is positioned to perform the interleaving duplex printing for sheets having the maximum length in Embodiment 2. Specifically, the position of the duplex sheet conveying roller 24 is set to meet a timing (including a time to reverse the direction of rotation of the duplex sheet conveying roller 24) to receive the leading edge S2*a* of the subsequent sheet S2 conveyed from the curved portion 22*c* of the reversing pathway 22 to the duplex sheet pathway 21 after the leading edge S1*a* (the trailing edge thereof when viewed in the conveyance direction) of the preceding sheet S1 that is reentered from the duplex sheet pathway 21 to the image transfer portion has passed. The appropriate position of the duplex sheet conveying roller 24 is determined based on the productivity and image formation timing of the printer 100A, the sheet conveyance speed, the path lengths and layout of sheet conveyance, and so forth.

According to Embodiment 2, the configuration of the duplex sheet inverting device 35 according to Embodiment 2 can reverse a sheet having a length longer than the length of the reversing pathway 22, without causing the sheet to appear to the outside of the duplex sheet inverting device 35. Specifically, the configuration of Embodiment 2 can switch back and turn over a sheet having the maximum length in the loop pathway 36, thereby minimizing the duplex sheet inverting device 35 that serves as a sheet inverting device and the printer 100A. In addition, the interleaving duplex printing can be performed when printing sheets on both sides sequentially, thereby enhancing the productivity in the duplex printing.

As described above, the loop pathways 16 and 36 have a long and loop shape and extend in an upward and downward direction or a vertical direction in Embodiments 1 and 2 and Modifications 1 and 2. However, for example, the long-shaped loop pathway that extends in a horizontal (lateral) direction or in a diagonal direction can be provided to the sheet inverting device and the image forming apparatus so as to reduce the size of the sheet inverting device and the image forming apparatus in the horizontal (lateral) direction and in the diagonal direction. The loop pathway is not limited to be a long shaped but can add various modifications to any applicable apparatus.

Further, the sheet inverting devices according to the present invention may be formed in a unit detachably attachable to the image forming apparatus, so as to be applicable to product forms.

As described above, the present invention is effective in the descriptions given in Embodiments 1 and 2.

Further, according to the present invention, when inverting the one-side printed sheet, the sheet does not appear to the outside of the sheet inverting device and the length of the first pathway (e.g., the reversing pathway 22) can be reduced. By so doing, the sheet inverting device and the image forming apparatus can be minimized.

Further, according to the present invention, the interleaving duplex printing method can be employed to print images on both sides of multiple sheets sequentially. By so doing, while the one-side printed sheet is being inverted, the subsequent sheet can be printed, thereby enhancing the productivity in duplex printing.

Further, according to the present invention, the height of the sheet inverting device of the vertical sheet conveyance type and the image forming apparatus incorporating the sheet inverting device can be reduced.

Further, according to the present invention, a sheet having either a relatively short length or a relatively long length can be inverted.

Further, according to the present invention, the time to reverse the direction of rotation of the redirectable sheet conveyance member can be controlled accurately.

Further, according to the present invention, the one-side printed sheet can be conveyed from the first pathway (e.g., the reversing pathway 22) to the second pathway reliably, thereby enhancing the reliability of sheet conveying operations.

Further, according to the simple configuration of the present invention, the resilience (rigidity) of sheet is used so that the one-side printed sheet can be conveyed from the first pathway (e.g., the reversing pathway 22) to the second pathway and the switched back sheet can be conveyed from the second pathway to the exit slot (e.g., the reentry slot 18).

Further, according to the simple configuration of the present invention, the resilience (rigidity) of, sheet is used so that the one-side printed sheet can be conveyed from the first pathway (e.g., the reversing pathway 22) to the second pathway reliably and the switched back sheet can be conveyed from the second pathway to the exit slot (e.g., the reentry slot 18) reliably.

Further, in the above-described sheet inverting device, the loop pathway includes a first pathway having a first end connected to the entrance slot, and a second pathway having a first end connected to the exit slot and positioned parallel to the first pathway. In the sheet inverting device having this configuration, the first end of the first pathway is connected to a second end of the second pathway and the first end of the second pathway is connected to a second end of the first pathway.

Further, in the above-described sheet inverting device, the second end of the first pathway is curved and connected to the first end of the second pathway.

Further, in the above-described sheet inverting device, the second end of the first pathway is connected to the first of the second pathway to cause the recording medium conveyed in the forward direction by a forward rotation of the redirectable sheet conveyance member to enter the second pathway in which the recording medium travels in the reverse direction from downstream to upstream.

Further, in the above-described sheet inverting device, the redirectable sheet conveyance member is disposed at the first pathway, the second end of the second pathway is connected to the first pathway at a downstream area in the vicinity of the first end of the first pathway, and the second end of the first pathway is curved and connected to the first end of the second pathway.

Further, in the above-described sheet inverting device, the redirectable sheet conveyance member is disposed at the first pathway, the second end of the second pathway is connected to the first pathway at a downstream area in the vicinity of the first end of the first pathway, and the second end of the first pathway is connected to the one end of the second pathway to cause the recording medium conveyed in the forward direction according to a forward rotation of the redirectable sheet conveyance member to enter the second pathway in which the recording medium travels in the reverse direction from downstream to upstream.

In addition, the sheet inverting device further includes a simultaneous sheet conveying member to simultaneously convey a first recording medium sheet conveyed to enter the first pathway via the entrance slot and a second recording medium sheet conveyed to enter the second end of the second pathway in the reverse direction from the first pathway in opposite directions.

Further, in the above-described sheet inverting device, a length of the first pathway is shorter than a maximum length of the recording medium to be reversed.

Further, in the above-described sheet inverting device, the first pathway and the second pathway extend substantially vertically.

In addition, the sheet inverting device further includes a sheet conveying member provided in the second pathway to convey the recording medium to the exit slot. In the sheet inverting device having this configuration, the sheet conveying member conveys the recording medium in forward and reverse directions.

In addition, the sheet inverting device further includes a sheet detector disposed in the vicinity of a junction of the second end of the second pathway and the first end of the first pathway to detect the recording medium as the recording medium passes thereby.

In addition, the sheet inverting device further includes a switching member to guide the recording medium conveyed in the first pathway and then redirected in the reverse direction by the redirectable sheet conveyance member to the second pathway.

In addition, the sheet inverting device further includes a reentry pathway to re-convey the recording medium traveling in the reverse direction therein, the reentry pathway having one end at which the exit slot is formed, a junction at which the second end of the first pathway is connected to the first end of the second pathway, a first guide member located at the junction, having a first conveyance guide surface that defines the second pathway and a first reverse guide surface that defines the first pathway, a second guide member located at the junction, having a second reverse guide surface disposed facing the first reverse guide surface that defines the first pathway, a first reentry guide surface that defines the reentry pathway, and a peak point at which the first reverse guide surface and the first reentry guide surface meet, and a third guide member having a second conveyance surface disposed facing the first conveyance guide that defines the second pathway. In the sheet inverting device having this configuration, the peak point is located at a position retreated from an extended plane of the first conveyance guide surface and an extended plane of the first reentry guide surface, toward the second pathway and the reentry pathway, the second conveyance guide surface and an extended line of the second reverse guide surface intersect the peak form an acute angle, and the first conveyance guide surface and an extended line of the first reentry guide surface intersect the peak form an acute angle.

Further, in the above-described sheet inverting device, the recording medium is conveyed through the second end of the first pathway in a sheet conveyance direction from downward from upward in the second pathway, the sheet inverting device further comprising an elastic guide member to guide the recording medium conveyed in the reverse direction from upstream to downstream in the sheet conveyance direction through the second pathway to the exit slot disposed at a junction of the second end of the first pathway and the first end of the second pathway. In addition, the recording medium with a first image on one side thereof enters the entrance slot, and the exit slot serves as a reentry slot to which the recording medium having the image on the first side is conveyed again in the reverse direction.

Further, an image forming apparatus forming images on both sides of a sheet includes the sheet inverting device according to one of the first through thirteenth techniques.

In addition, the image forming apparatus further includes a sheet container to contain multiple recording media sheets therein, an image forming unit disposed above the sheet container to form images on the recording medium conveyed from the sheet container, and a space provided above the image forming unit to which the recording media are discharged after image formation. In the image forming apparatus having this configuration, the first pathway and the second pathway of the sheet inverting device extend substantially vertically.

The above-described embodiments are illustrative and do not limit the present invention. Thus, numerous additional modifications and variations are possible in light of the above teachings. For example, elements or features of different illustrative and exemplary embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

The invention claimed is:

1. A sheet inverting device, comprising:

a loop pathway comprising an entrance slot to which a recording medium is conveyed and an exit slot from which the recording medium is conveyed, the loop pathway forming a loop shape to convey the recording medium therethrough in a forward direction defined by a sheet conveyance direction in which the recording medium is conveyed from the entrance slot;

a redirectable sheet conveyance member configured to convey the recording medium traveling through the loop pathway in the forward direction and a reverse direction that is the reverse of the forward direction, the recording medium conveyed by the redirectable sheet conveyance member in the reverse direction is conveyed from the exit slot out of the loop pathway;

an export pathway that extends below the loop path to convey the recording medium to be ejected through the exit slot, wherein the loop pathway further comprises:

a first pathway extending from the entrance slot to the exit slot to convey the recording medium therethrough in the forward direction;

a second pathway extending from the exit slot to the entrance slot to convey the recording medium therethrough in the forward direction such that the recording medium conveyed in the forward direction in the first pathway to the second pathway passes the exit slot; and a first angle formed between the second pathway and the export pathway is greater than a second angle formed between the first pathway and the export pathway in the vicinity of the exit slot; and a sheet reentry pathway that serves as the export pathway and extends below the first pathway to re-convey the recording medium traveling in the reverse direction therein, the reentry pathway having one end at which the exit slot is formed.

2. The sheet inverting device according to claim 1, wherein the first pathway and the second pathway extend substantially vertically.

3. The sheet inverting device according to claim 1, further comprising a sheet conveying member provided in the second pathway to convey the recording medium to the exit slot, wherein the sheet conveying member conveys the recording medium in forward and reverse directions.

4. The sheet inverting device according to claim 1, further comprising a switching member to guide the recording medium conveyed in the first pathway and then redirected in the reverse direction by the redirectable sheet conveyance member to the second pathway.

5. The sheet inverting device according to claim 1, further comprising:

a junction at which the second end of the first pathway is connected to the first end of the second pathway;

a first guide member located at the junction, having a first conveyance guide surface that defines the second pathway and a first inverting guide surface that defines the first pathway;

a second guide member located at the junction, having a second inverting guide surface disposed facing the first inverting guide surface that defines the first pathway, a first reentry guide surface that extends below the second inverting guide surface and defines the reentry pathway, and a peak point at which the second inverting guide surface and the first reentry guide surface meet; and a third guide member having a second conveyance guide surface disposed facing the first conveyance guide surface that defines the second pathway, wherein the peak point is located at a position retreated from an extended plane of the first conveyance guide surface and an extended plane of the first reentry guide surface, toward the first pathway and the reentry pathway, the second conveyance guide surface and an extended line of the second inverting guide surface intersecting the peak form an acute angle, the first conveyance guide surface and an extended line of the first reentry guide surface intersecting the peak form an acute angle.

6. The sheet inverting device according to claim 1, wherein the loop pathway further comprises:

a first angle formed between the second pathway and the export pathway is greater than a third angle formed between the first pathway and the second pathway in the vicinity of the exit slot.

7. The sheet inverting device according to claim 1, wherein the loop pathway comprises:

a guide member to guide the recording medium to be conveyed through the second pathway in the reverse direction to eject the recording medium from the exit slot without conveying the recording medium back to the first pathway.

8. The sheet inverting device according to claim 1, wherein the loop pathway comprises:

a first pathway having a first end connected to the entrance slot; and a second pathway having a first end connected to the exit slot and positioned parallel to the first pathway, wherein the first end of the first pathway is connected to a second end of the second pathway and the first end of the second pathway is connected to a second end of the first pathway.

9. The sheet inverting device according to claim 8, wherein a portion of the loop pathway formed by the first pathway, the second end of the first pathway and the first end of the second pathway forms a curve of more than 180°.

10. The sheet inverting device according to claim 8, wherein the second end of the first pathway is connected to a first end of the second pathway to cause the recording medium conveyed in the forward direction by a forward rotation of the redirectable sheet conveyance member to enter the second pathway in which the recording medium travels in the reverse direction from downstream to upstream.

11. The sheet inverting device according to claim 8, wherein the redirectable sheet conveyance member is disposed at the first pathway, the second end of the second pathway being connected to the first pathway at a downstream area in the vicinity of the first end of the first pathway, the second end of the first pathway being curved and connected to the first end of the second pathway.

12. The sheet inverting device according to claim 11, further comprising a simultaneous sheet conveying member to simultaneously convey a first recording medium sheet conveyed to enter the first pathway via the entrance slot and a second recording medium sheet conveyed to enter the second end of the second pathway in the reverse direction from the first pathway in opposite directions.

13. The sheet inverting device according to claim 8, wherein the redirectable sheet conveyance member is disposed at the first pathway, the second end of the second pathway being connected to the first pathway at a downstream area in the vicinity of the first end of the first pathway, the second end of the first pathway being connected to the first end of the second pathway to cause the recording medium conveyed in the forward direction according to a forward rotation of the redirectable sheet conveyance member to enter the second pathway in which the recording medium travels in the reverse direction from downstream to upstream.

14. The sheet inverting device according to claim 8, wherein a length of the first pathway is shorter than a maximum length of the recording medium to be reversed.

15. The sheet inverting device according to claim 8, further comprising a sheet detector disposed in the vicinity of a junction of the second end of the second pathway and the first end of the first pathway to detect the recording medium as the recording medium passes thereby.

16. The sheet inverting device according to claim 8, wherein the recording medium is conveyed through the second end of the first pathway in a sheet conveyance direction from downward to upward in the second pathway, the sheet inverting device further comprising an elastic guide member to guide the recording medium conveyed in the reverse direction from upstream to downstream in the sheet conveyance direction through the second pathway to the exit slot disposed at a junction of the second end of the first pathway and the first end of the second pathway.

17. The sheet inverting device according to claim 1, wherein the recording medium with a first image on one side thereof enters the entrance slot, and the exit slot serves as a reentry slot to which the recording medium having the image on the first side is conveyed again in the reverse direction.

18. An image forming apparatus forming images on both sides of a sheet, the image forming apparatus comprising the sheet inverting device according to claim 1.

19. The image forming apparatus according to claim 18, further comprising:

a sheet container to contain multiple recording media sheets therein;

an image forming unit disposed above the sheet container to form images on the recording medium conveyed from the sheet container; and a space provided above the image forming unit to which the recording media are discharged after image formation, wherein the first pathway and the second pathway of the sheet inverting device extend substantially vertically.

* * * * *